US006364444B1

(12) United States Patent
Ota

(10) Patent No.: US 6,364,444 B1
(45) Date of Patent: Apr. 2, 2002

(54) APPARATUS FOR AND METHOD OF DRIVING INK-JET RECORDING HEAD FOR CONTROLLING AMOUNT OF DISCHARGED INK DROP

(75) Inventor: Takashi Ota, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/556,334

(22) Filed: Apr. 24, 2000

(30) Foreign Application Priority Data

May 6, 1999 (JP) ..... 11-125775

(51) Int. Cl.[7] ..... B41J 29/38
(52) U.S. Cl. ..... 347/10; 347/9; 347/11
(58) Field of Search ..... 347/10, 11

(56) References Cited

U.S. PATENT DOCUMENTS

| | | | | | |
|---|---|---|---|---|---|
| 5,980,015 | A | * | 11/1999 | Saruta | 347/15 |
| 6,029,896 | A | * | 2/2000 | Self et al. | 239/4 |
| 6,095,630 | A | * | 8/2000 | Horii et al. | 347/10 |
| 6,206,496 | B1 | * | 3/2001 | Ushioda | 347/10 |
| 6,257,686 | B1 | * | 7/2001 | Takahashi et al. | 347/10 |

FOREIGN PATENT DOCUMENTS

| | | | | |
|---|---|---|---|---|
| EP | 0 738 598 | A2 | 10/1996 | B41J/2/045 |
| EP | 0 827 838 | A2 | 3/1998 | B41J/2/21 |
| EP | 0 858 892 | A1 | 8/1998 | B41J/2/07 |
| EP | 0 902 587 | A2 | 3/1999 | H04N/1/40 |
| JP | 1-242259 | | 9/1989 | B41J/3/04 |
| JP | 9-11457 | * | 1/1997 | B41J/2/045 |
| JP | 9-226106 | | 9/1997 | B41J/2/01 |
| JP | WO97/37852 | | 10/1997 | B41J/2/045 |
| JP | 10-81012 | * | 3/1998 | B41J/2/045 |
| JP | 10-81014 | * | 3/1998 | B41J/2/045 |
| JP | 10-109433 | | 4/1998 | B41J/2/25 |
| JP | 10-138475 | | 5/1998 | B41J/2/045 |
| JP | 11-42774 | | 2/1999 | B41J/2/015 |

* cited by examiner

*Primary Examiner*—John Barlow
*Assistant Examiner*—Alfred Dudding
(74) *Attorney, Agent, or Firm*—McGinn&Gibb, PLLC

(57) ABSTRACT

An apparatus for driving an ink-jet recording head includes a piezoelectric device, a drive waveform generation circuit, a waveform extraction circuit. The drive waveform generation circuit generates a drive waveform in which n basic waveforms are connected in series, each of the n basic waveforms having a single period, where n is an integer equal to or greater than 2. The waveform extraction circuit which extracts m (m is an integer, and $0 \leqq m \leqq n$) of the n basic waveforms as a print drive waveform based on an externally supplied print data, and applies the print drive waveform to the piezoelectric device. Thereby, an ink is discharged from a nozzle based on a distortion of the piezoelectric device.

54 Claims, 20 Drawing Sheets

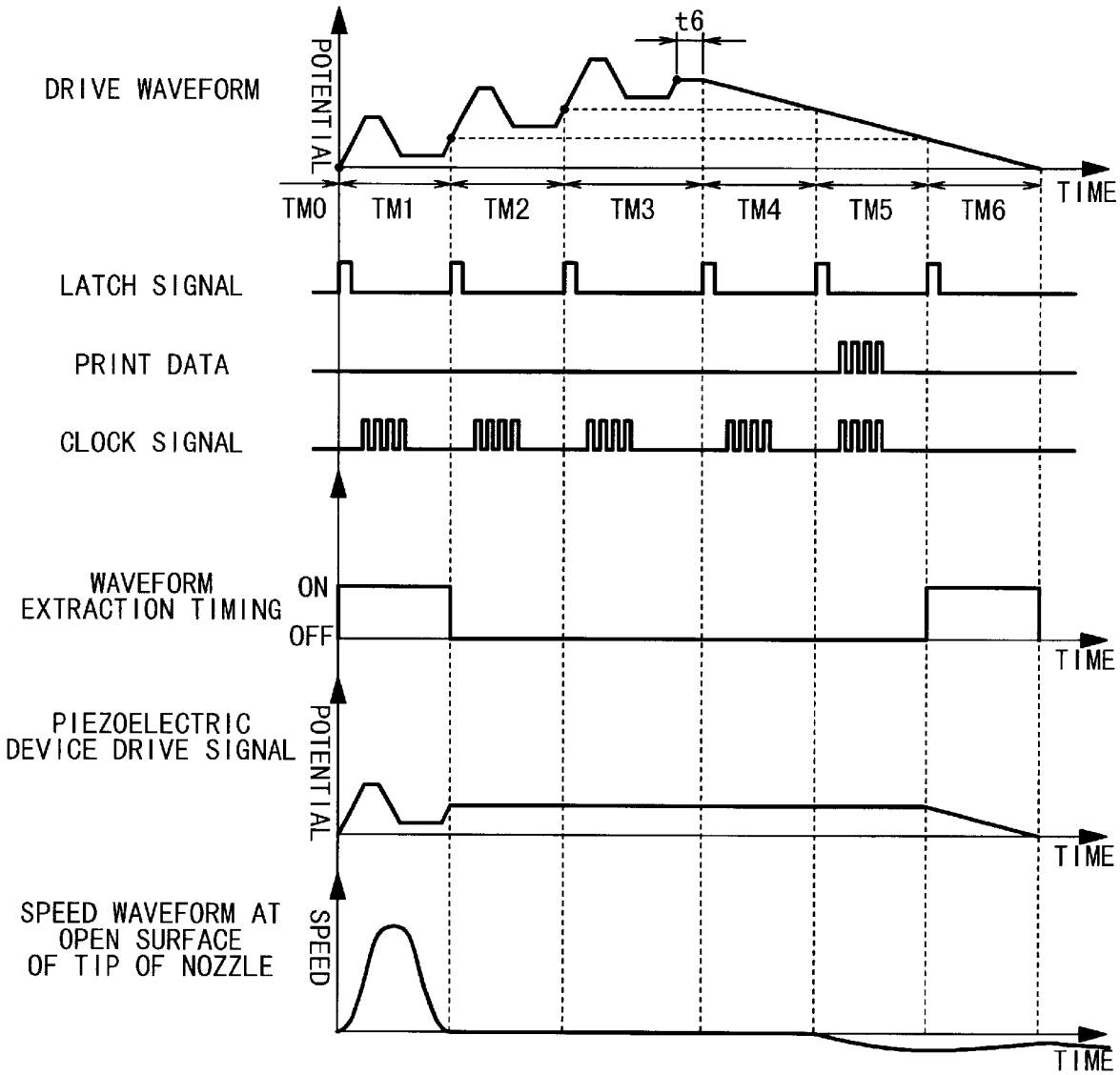
Fig. 11A DRIVE WAVEFORM
Fig. 11B LATCH SIGNAL
Fig. 11C PRINT DATA
Fig. 11D CLOCK SIGNAL
Fig. 11E WAVEFORM EXTRACTION TIMING
Fig. 11F PIEZOELECTRIC DEVICE DRIVE SIGNAL
Fig. 11G SPEED WAVEFORM AT OPEN SURFACE OF TIP OF NOZZLE

Fig. 13

| CONDITION NO. | 1 | 2 | 3 | 4 | 5 | 6 |
|---|---|---|---|---|---|---|
| t1/Tc | 0.1 | 0.1 | 0.05 | 0.15 | 0.2 | 0.4 |
| t2/Tc | 0.03 | 0 | 0.03 | 0.03 | 0.03 | 0.03 |
| t3/Tc | 0.1 | 0.1 | 0.05 | 0.135 | 0.133 | 0.073 |
| t4/Tc | 0.08 | 0.105 | 0.16 | 0.03 | 0.03 | 0.03 |
| t5/Tc | 0.066 | 0.05 | 0.02 | 0.12 | 0.15 | 0.25 |
| V1[V] | 8.6 | 10.3 | 11 | 7.7 | 7.5 | 8.4 |
| V2[V] | 8.6 | 10.3 | 11 | 6.9 | 5 | 1.5 |
| V3[V] | 5.6 | 5.1 | 4.4 | 6.2 | 5.6 | 5.3 |
| AMOUNTS OF DISCHARGED INK DROP: ONE-MOUNTAIN DRIVE: [$Fm^3$] | 5 | 5 | 4 | 6 | 8 | 11 |
| AMOUNTS OF DISCHARGED INK DROP: TWO-MOUNTAIN DRIVE: [$Fm^3$] | 10 | 10 | 8 | 12 | 16 | 22 |
| AMOUNTS OF DISCHARGED INK DROP: THREE-MOUNTAIN DRIVE: [$Fm^3$] | 15 | 15 | 12 | 18 | 24 | 33 |

APPARATUS FOR AND METHOD OF DRIVING INK-JET RECORDING HEAD FOR CONTROLLING AMOUNT OF DISCHARGED INK DROP

BACKGROUND OF THE INVENTION

1. Field of the Invention

The present invention relates to an apparatus for and method of driving an ink-jet recording head used in a printer, a facsimile, a copier and the like. More particularly, the present invention relates to a technique of controlling an amount of a discharged ink drop.

2. Description of the Related Art

Conventionally, an ink-jet type recorder employing an ink-jet recording head has been well known. The ink-jet recording head used in this ink-jet type recorder is equipped with a plurality of nozzles in a vertical scanning direction or an advancing direction of a paper, and is moved to a horizontal scanning direction or an orthogonal direction to the advancing direction of the paper by a carriage mechanism. The nozzles of the ink-jet recording head discharge ink drops respectively at predetermined timings in accordance with a dot pattern data produced by spreading out print data. Accordingly, the ink drops from the respective nozzles are deposited on a record paper to thereby carry out a printing operation. In the ink-jet type recorder described above, the print is carried out by whether or not discharging the ink drops, namely, by controlling an on/off of dot. Thus, the above-mentioned ink-jet type recorder can not represent a halftone, such as a gray.

Therefore, a method of composing one pixel by a plurality of dots is employed to represent the halftone. In this method, when one pixel is represented by a dot matrix of 4×4, the shade can be represented by 16 tones (17 tones, if including a pure white). Increase of the number of dots per pixel enables the representation of further fine tones. However, a substantial resolution is reduced if the tone is made finer without changing a dot diameter. Also, if a diameter of a record dot formed on the record paper is large, this makes the graininess in a low concentration area prominent, which accordingly reduces the quality of print.

Those problems can be solved by reducing the weight of the ink drop and making the diameter of the record dot thinner. However, the thinner diameter of the record dot causes a print speed to be slower. In order to prevent from the decrease of this print speed, such a technique may be considered that a discharge interval of the ink drops is made shorter, or the number of nozzles is increased but neither is easy.

In order to solve above-mentioned problems, Japanese Laid Open Patent Application (JP-A-Heisei 9-11457) discloses "an apparatus for driving an ink-jet recording head", which can control an amount of ink drops is charged from one nozzle and accordingly changing a size of a record dot to thereby carry out a fine tone representation. In this driving apparatus, a drive signal is sent to a piezoelectric device mounted correspondingly to each of a plurality of nozzles. The piezoelectric device is expanded and contracted in accordance with the supplied drive signal. Thus, the expansion and contraction causes a pressure change in a pressure room (in which ink is accommodated) mounted correspondingly to each of the plurality of nozzles. As a result, ink drops with an amount in accordance with the pressure change are discharged from each nozzle.

The drive signal used in this driving apparatus is generated by simultaneously generating a plurality of waveform signals having shapes different from each other, and then selecting one waveform signal from the plurality of waveform signals, in accordance with a print data. Accordingly, the amount of inks discharged from the nozzle is controlled in accordance with the waveform signal, a diameter of a record dot deposited on a record paper can be changed.

Also, Japanese Laid Open Patent Application (JP-A-Heisei 10-81012) discloses "an apparatus for and a method of driving an ink-jet type printer head", which is operated under the principle similar to the above-mentioned apparatus for driving an ink-jet recording head. A drive signal used in this driving apparatus includes four drive pulses within a print period required to generate one record dot. Then, in every print period, one or more drive pulses selected from the four drive pulses in accordance with a print data are sequentially sent to a pressure generation device.

Accordingly, the pressure generation device causes the pressure change in accordance with the drive pulse. Thus, the amount of ink drops is discharged on the basis of this pressure change. Hence, when one drive pulse is sent to the pressure generation device, one ink drop is discharged within the print period. When a plurality of drive pulses are sequentially sent to the pressure generation device, a plurality of ink drops are discharged within the print period. Accordingly, the amount of inks deposited on a record paper can be controlled to thereby control the diameter of the record dot.

Moreover, Japanese Laid Open Patent Application (JP-A-Heisei, 10-81014) discloses "an apparatus for and a method of driving an ink-jet type printer head", which uses a drive signal composed of three drive pulses, and controls an amount of inks deposited on a record paper to thereby change a diameter of a record dot. So, this is not the above-mentioned drive signal composed of the four drive pulses as noted in Japanese Laid Open Patent Application (JP-A-Heisei, 10-81012).

If the apparatus for driving an ink-jet recording head is used, which is disclosed in the above-mentioned Japanese Laid Open Patent Application (JP-A-Heisei 9-11457), a print speed can be improved without increasing the number of nozzles. However, it is necessary to mount hardware (actually, a transfer gate) to select one waveform signal from the plurality of waveform signals in response to each of the plurality of piezoelectric devices. Thus, the amount of hardware is extremely vast. For example, in such a case that the amount of ink drops is varied in three stages, the transfer gate equal to three times the number of nozzles are required. This results in a problem that the driving apparatus can not be made compact and its cost becomes expensive.

Also, if the techniques disclosed in Japanese Laid Open Patent Application (JP-A-Heisei 10-81012) and Japanese Laid Open Patent Application (JP-A-Heisei 10-81014) are used, the print speed can be improved without increasing the number of nozzles and it is not necessary to select one waveform signal from the plurality of waveform signals. Thus, the hardware to select the waveform signal is not required. However, at least one drive pulse among a plurality of drive pulses outputted for each print period is generated such that a part of the drive signal is substantially equal to a Helmholtz period. Hence, there is a limit in making the print period shorter to thereby make the print speed faster. Also, the drive pulses according to the amount of the ink drop to be discharged from the plurality of drive pulse in the print period are sequentially sent to the pressure generation device. Hence, the discharge timing of the ink drop is different depending on the drive pulse to be sent. This results in a problem that a positional deviation of the deposition of the ink drop is induced to thereby deteriorate the quality of print. For example, a temporal period between first and third pulses is half the print period. Hence, a dot of the first pulse and a dot of the third pulse are deviated by a half pitch from each other. If the dot pitch is defined as 720 dot/inch (=35 μm), they are deviated by 18 μm from each other.

SUMMARY OF THE INVENTION

The present invention is accomplished in view of the above mentioned problems. Therefore, an object of the present invention is to provide an apparatus for and a method of driving an ink-jet recording head, which are small and cheap and can control an amount of ink drops discharged from a nozzle so as to make a print speed faster and also improve a print quality.

An apparatus for driving an ink-jet recording head, according to a first aspect of the present invention, includes a drive waveform generation circuit, a waveform extraction circuit. The drive waveform generation circuit generates a drive waveform in which n basic waveforms are connected in series, each of the n basic waveforms having a single period, where n is an integer equal to or greater than 2. The waveform extraction circuit which extracts m (m is an integer, and $0 \leqq m \leqq n$) of the n basic waveforms as a print drive waveform based on an externally supplied print data, and applies the print drive waveform to the piezoelectric device. Thereby, an ink is discharged from a nozzle based on a distortion of the piezoelectric device.

A method of driving an ink-jet recording head, according to a second aspect of the present invention, includes a generating step, an extracting step and an applying step. The generating step generates a drive waveform in which n basic waveforms are connected in series, each of the n basic waveforms having a single period, where n is an integer equal to or greater than 2. The extracting step extracts m (m is an integer, and $0 \leqq m \leqq n$) of the n basic waveforms as a print drive waveform based on an externally supplied print data. The applying step applies the print drive waveform to a piezoelectric device to thereby discharge an ink from a nozzle based on a distortion of the piezoelectric device.

BRIEF DESCRIPTION OF THE DRAWINGS

FIGS. 11A to 11G are timing charts describing an operation when one mountain is driven by using a predetermined drive waveform in the apparatus for driving the ink-jet recording head according to the first embodiment of the present invention;

FIG. 13 is a view describing a result when an amount of ink drops is measured, in the apparatus for driving the ink-jet recording head according to the first embodiment of the present invention;

DESCRIPTION OF THE PREFERRED EMBODIMENTS (First Embodiment)

Figure 1:
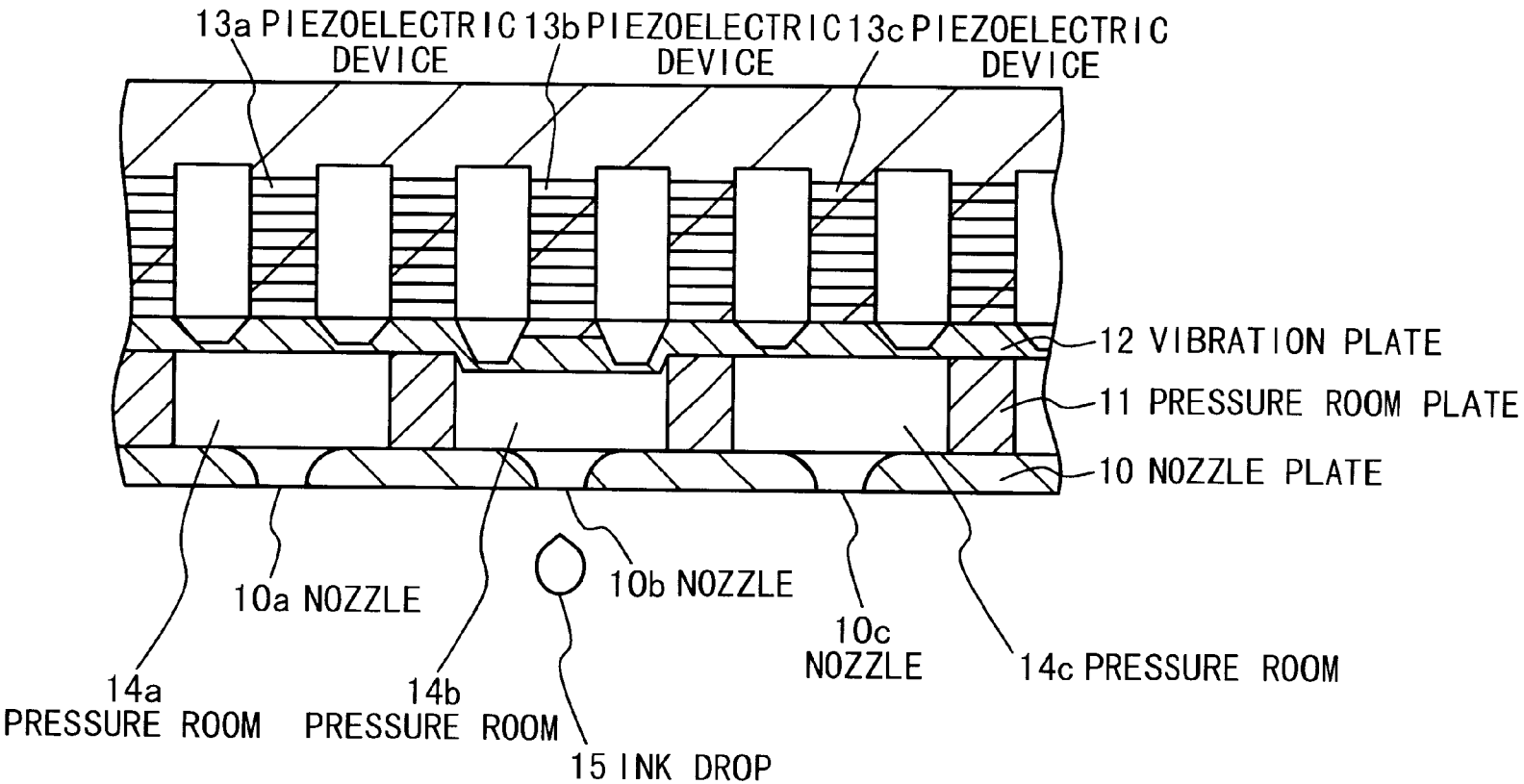
FIG. 1 is a view showing a mechanic configuration of an ink-jet recording head to which a driving apparatus according to a first embodiment of the present invention is applied.

FIG. 1 partially shows the mechanical structure of an ink-jet recording head to which a driving apparatus according to a first embodiment of the present invention is applied. This ink-jet recording head employs a method of discharging ink drops by pressing a pressure room in which ink is accommodated, by using a piezoelectric device.

In this ink-jet recording head, a vibration plate 12 is mounted through pressure room plates 11 on a nozzle plate 10, and piezoelectric devices 13*a,* 13*b* and 13*c* are further mounted on this vibration plate 12. As the respective piezoelectric devices 13*a,* 13*b* and 13*c,* a lamination type of piezoelectric device is used which is composed by laminating piezoelectric materials.

As shown in FIG. 1, the nozzle plate 10, the pressure room plates 11 and the vibration plate 12 constitute a plurality of pressure rooms 14*a,* 14*b* and 14*c*. Nozzles 10*a,* 10*b* and 10*c,* which have R-shaped sections and are linked to the pressure rooms 14*a,* 14*b* and 14*c,* respectively, are formed in the nozzle plate 10. Although not shown, supply ports for supplying inks are provided in the respective pressure rooms 14*a,* 14*b* and 14*c*.

In the ink-jet recording head having the above-mentioned configuration, when a voltage is applied to the piezoelectric device 13*b,* the piezoelectric device 13*b* is extended to a downward direction of FIG. 1 to thereby compress the ink in the pressure room 14*b*. Accordingly, an ink drop 15 is discharged from the nozzle 10*b*. A character, a figure or the like is recorded on a record medium such as a print paper and the like by driving piezoelectric devices at a predetermined timing in accordance with a print data sent from outer portion, while this ink-jet recording head is relatively moved with respect to the record medium.

Figure 2:
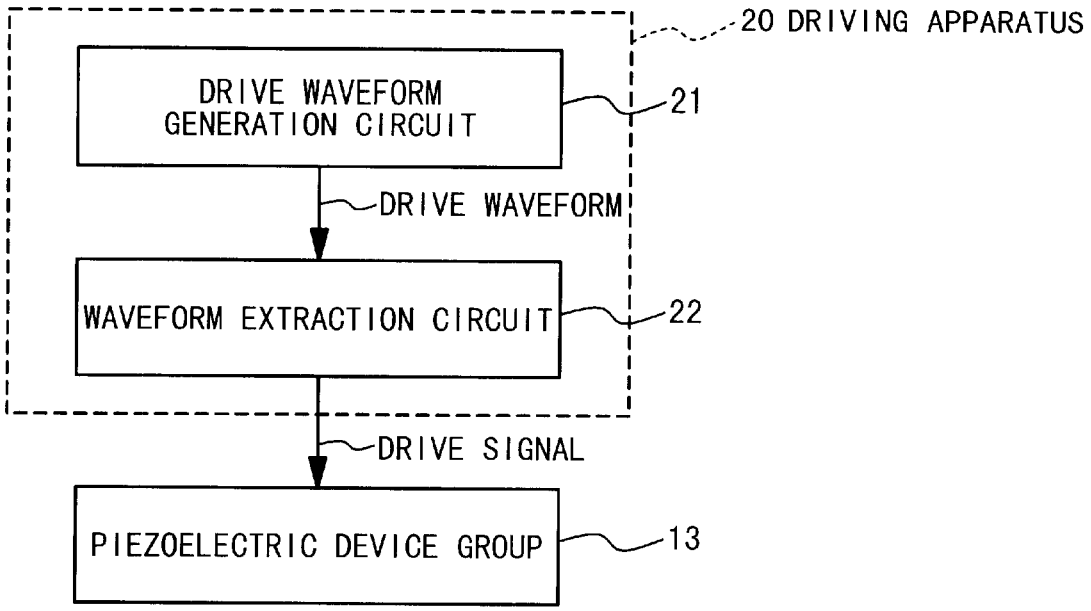
FIG. 2 is a block diagram schematically showing the configuration of the apparatus for driving the ink-jet recording head according to the first embodiment of the present invention.

FIG. 2 is a block diagram schematically showing the configuration of a driving apparatus 20 for the ink-jet recording head according to the first embodiment of the present invention. This driving apparatus 20 is equipped with a drive waveform generation circuit 21 and a waveform extraction circuit 22.

The drive waveform generation circuit 21 successively generates a drive waveform at a predetermined frequency. This drive waveform generated by the drive waveform generation circuit 21 is sent to the waveform extraction circuit 22. The waveform extraction circuit 22 extracts a part or a whole of the drive waveform sent from the drive waveform generation circuit 21, in accordance with a print data, and thereby generates a drive signal. This drive signal generated by the waveform extraction circuit 22 is applied to a piezoelectric device group 13 to accordingly drive respective piezoelectric devices contained in the piezoelectric device group 13.

Figure 3A:
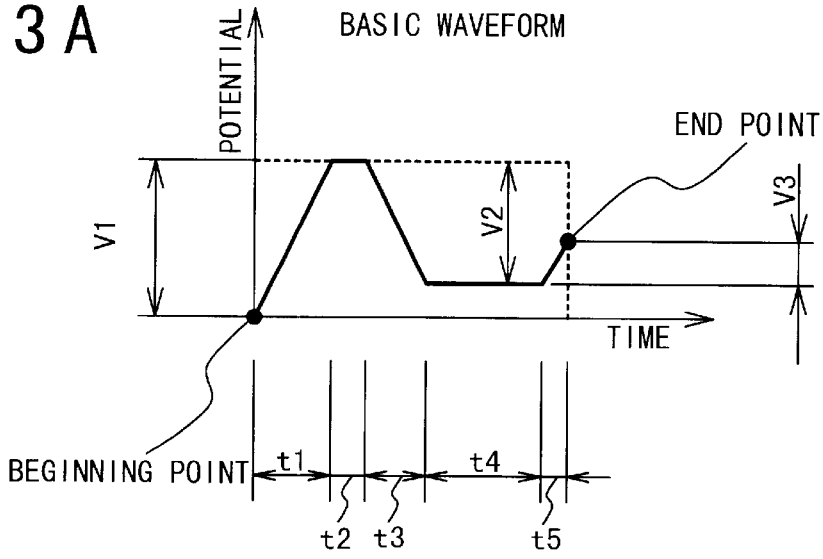
FIGS. 3A to 3C are waveform views showing a basic waveform included in a drive waveform used in the apparatus for driving the ink-jet recording head according to the first embodiment of the present invention.

A basic waveform used to generate the drive waveform will be described below. As shown in FIG. 3A, the drive waveform is composed of a first rising portion, a first retaining portion following this first rising portion, a falling portion following this first retaining portion, a second retaining portion following this falling portion and a second rising portion following this second retaining portion. These sections have time periods t1, t2, t3, t4 and t5, respectively. A potential difference at the first rising portion is V1, a potential difference at the falling portion is V2, and a potential difference at the second rising portion is V3. The voltage V1 can be arbitrarily determined depending on the structure of the ink-jet recording head.

Figure 3B:
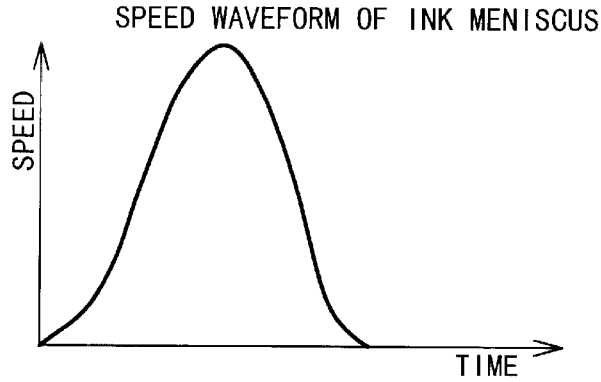
Figure 3C:
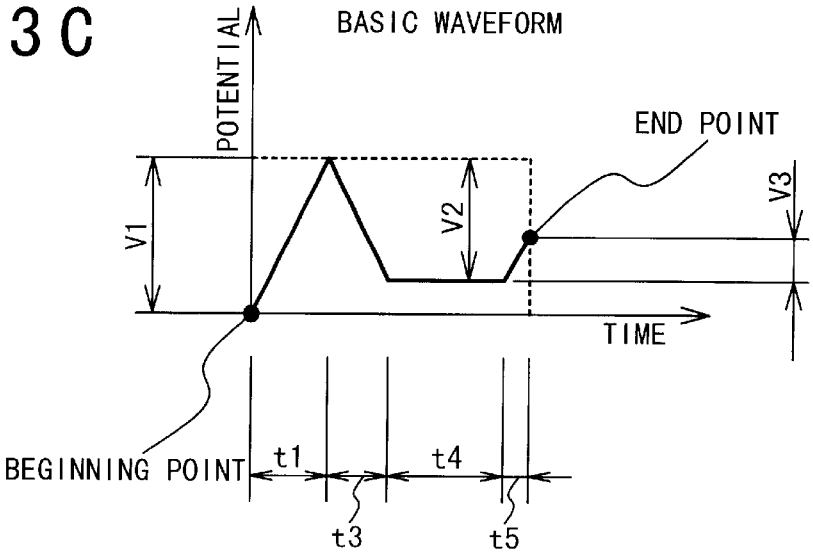

Here, if a peculiar to the ink flow path is assumed to be Tc, the basic waveform has a time period t1 of "0.1×Tc", a time period t2 of "0.03×Tc", a time period t3 of "0.1×Tc", a time period t4 of "0.08×Tc" and a time period t5 of "0.066×Tc". Also, the basic waveform is. generated such that an inclination of the first rising portion is equal to that of the second rising portion. In this first embodiment, the basic waveform is designed such that the inclination of the first rising portion is equal to that of the second rising portion. However, it is not necessary that they are always equal to each other. The equal case has a merit that the drive waveform generation circuit 21 is simplified and its cost becomes low. It should be noted that a waveform in which the time period t2 is zero may be used as the basic waveform, as shown in FIG. 3C.

Such a basic waveform is sent to the piezoelectric device of the ink-jet recording head. Then, when a speed waveform of an ink meniscus on an open surface of a nozzle tip is measured, such a fact is confirmed that a residual vibration is not substantially induced after a speed waveform of one mountain is generated, as shown in FIG. 3B. Also, such a fact is confirmed that a value obtained by multiplying an area of the mountain of the speed waveform by an area of the open surface of the nozzle tip is substantially equal to that of discharged ink drops.

The speed waveform of the ink meniscus in the open surface of the nozzle tip is determined by the following procedure. Applying the waveform whose voltage is reduced to a level at which the ink drop is not discharged, by multiplying only a voltage value of a voltage waveform applied to the piezoelectric device by a certain magnification $\alpha$ (<1), to the piezoelectric device, and then measuring the speed waveform of the ink meniscus in the open surface of the nozzle tip at that time by using a laser Doppler speed meter, and further multiplying only the speed value of the obtained waveform by $1/\alpha$. Also, the speed waveform can be determined by performing an acoustic simulation.

Figures 5A, 5B:
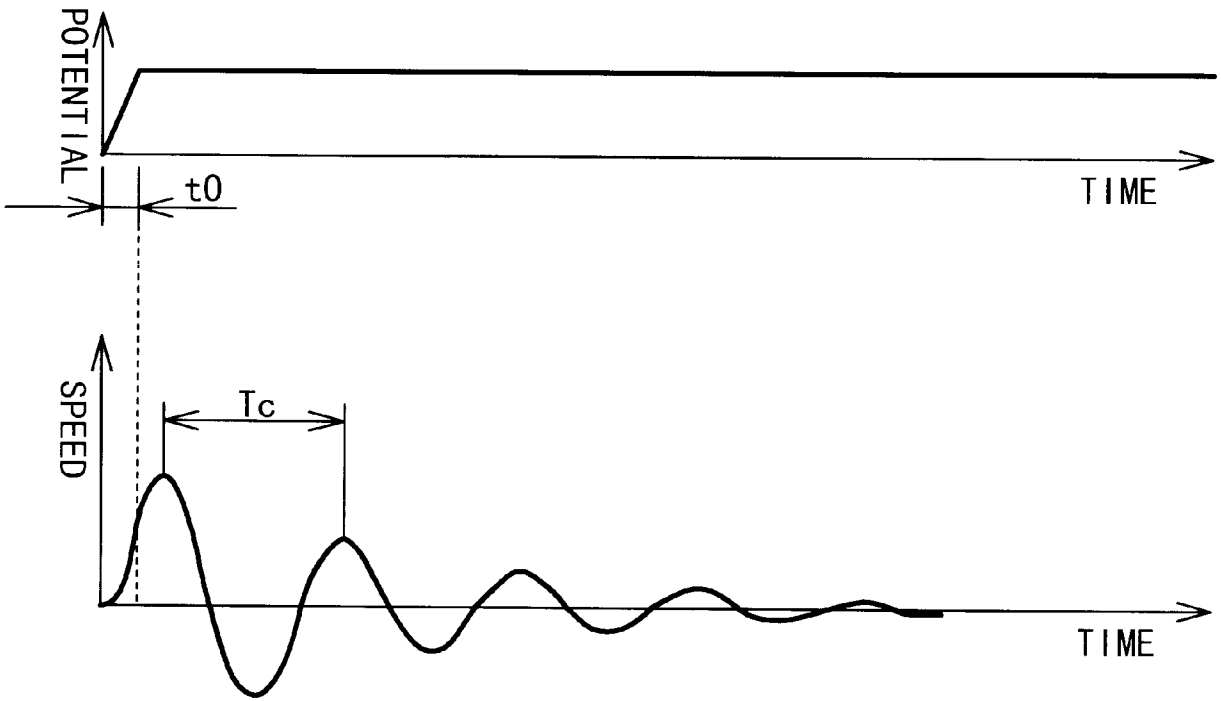
FIGS. 5A and 5B are views describing a period peculiar to an ink flow path in the apparatus for driving the ink-jet recording head according to the first embodiment of the present invention.

The above-mentioned period Tc peculiar to the ink flow path can be determined as follows. That is, a low voltage waveform having such a amplitude with the degree that the ink drop is not discharged from the nozzle, for example, a voltage waveform rising up to a predetermined voltage in a predetermined time period tO as shown in FIG. 5A is sent to the piezoelectric device. Then, an operation of the ink meniscus in the open surface of the nozzle tip at that time is measured by using the laser Doppler speed meter to accordingly obtain a speed waveform shown in FIG. 5B. Next, a time between mountains appearing after the elapse of the time period t0 is determined with regard to this speed waveform. This determined time period is the period Tc peculiar to the ink flow path. It should be noted that this period Tc peculiar to the ink flow path can be determined by simulation.

Figure 4A:
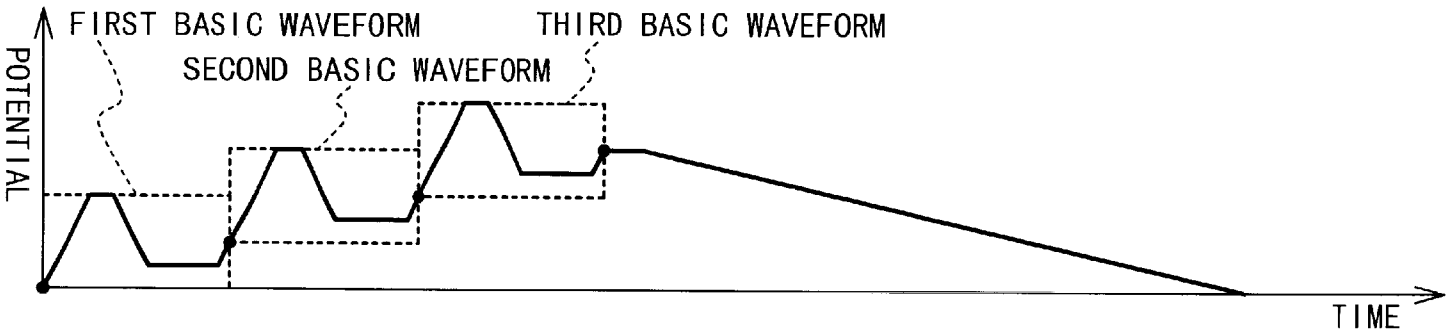
FIGS. 4A and 4B are waveform views showing a drive waveform to drive a piezoelectric device used in the apparatus for driving the ink-jet recording head according to the first embodiment of the present invention.

The drive waveform is generated by connecting a plurality of above-mentioned basic waveforms. This drive waveform has a shape shown in FIG. 4A. That is, a beginning point of a second basic waveform is connected to an end point of a first basic waveform. A beginning point of a third basic waveform is connected to an end point of the second basic waveform. Then, it falls down to the voltage at the beginning point of the first basic waveform, after an elapse of a certain period, from the end point of the third basic waveform. In this first embodiment, the three basic waveforms are used to configure the drive waveform. However, the number of basic waveforms may be arbitrarily determined so that it is not limited to three.

Figure 4B:
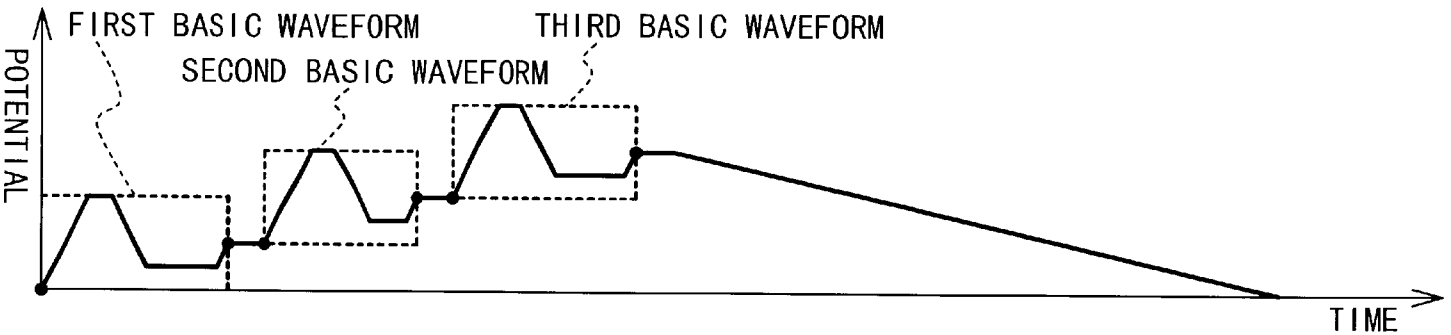

Also, the drive waveform may have a shape shown in FIG. 4B. That is, an end point of the first basic waveform is connected to a beginning point of the first retaining portion for retaining a level of the end point. An end point of the first retaining portion is connected to a beginning point of the second basic waveform. An end point of the second basic waveform is connected to a beginning point of the second retaining portion for retaining a level of the end point. An end point of the second retaining portion is connected to a beginning point of the third basic waveform. Then, it falls down to a voltage of the beginning point of the first basic waveform, after an elapse of a certain period, from the end point of the third basic waveform. In addition, in the following explanation, the drive waveform shown in FIG. 4A will be referred to.

The detailed configuration of the drive waveform generation circuit 21 will be described below with reference to a circuit diagram shown in FIG. 6. This drive waveform generation circuit 21 is composed of a first charging constant current circuit 210, a second charging constant current circuit 211, a first discharging constant current circuit 212, a second discharging constant current circuit 213, transistors Tr1, Tr2, resistors R1, R2, R3, R4, R5 and R6, a condenser C and a current amplifier 214. Timing signals T1, T2, T3 and T4 from a timing generation circuit (not shown) are sent to this drive waveform generation circuit 21.

The first charging constant current circuit 210 is composed of transistors Q1*a*, Q2*a* and a resistor R10*a*. A collector of the transistor Tr1 is connected through the resistor R2 to a control terminal Tc1 of the first charging constant current circuit 210. An emitter of this transistor Tr1 is grounded, and the timing signal T1 is inputted through the resistor R1 to a base of the transistor Tr1. An output terminal To of the first charging constant current circuit 210 is connected to a first terminal of the condenser C. A second terminal of the condenser C is grounded. The first charging constant current circuit 210 is activated when the timing signal T1 becomes in a high level (hereafter, referred to as an H level) to thereby output a current of a predetermined value.

The configuration of the second charging constant current circuit 211 is identical to that of the first charging constant current circuit 210. The characteristics of the transistors Q1*b*, Q2*b* and the value of the resistor R10*b* are also identical. A collector of the transistor Tr2 is connected through the resistor R4 to a control terminal Tc2 of the second charging constant current circuit 211. An emitter of the transistor Tr2 is grounded, and the timing signal T2 is inputted through the resistor R3 to a base of the transistor Tr2. An output terminal To of the second charging constant current circuit 211 is connected to the first terminal of the condenser C. The second charging constant current circuit 211 is activated when the timing signal T2 becomes in the H level to thereby output the current equal to that of the first charging constant current circuit 210.

The first discharging constant current circuit 212 is composed of transistors Q3, Q4 and a resistor R20. The timing signal T3 is inputted through the resistor R5 to a control terminal Tc4 of the first discharging constant current circuit 212. Also, an input terminal Ti of the first discharging constant current circuit 212 is connected to the first terminal of the condenser C. The first discharging constant current circuit 212 is activated when the timing signal T3 becomes in the H level. Then, it receives a current from the input terminal Ti.

The second discharging constant current circuit 213 is composed of transistors Q5, Q6 and a resistor R30. The timing signal T4 is inputted through the resistor R6 to a control terminal Tc3 of the second discharging constant current circuit 213. Also, an input terminal Ti of the second discharging constant current circuit 213 is connected to the first terminal of the condenser C. The second discharging constant current circuit 213 is activated when the timing signal T4 becomes in the H level. Then, it receives the current from the input terminal Ti.

As mentioned above, the first terminal of the condenser C is connected to the respective output terminals To of the first charging constant current circuit 210 and the second charging constant current circuit 211 and the respective input terminals Ti of the first discharging constant current circuit 212 and the second discharging constant current circuit 213 and an input terminal of the current amplifier 214. The condenser C is charged by the current flowed in from the activated first charging constant current circuit 210 and the second charging constant current circuit 211. On the other hand, the charges accumulated in the condenser C are discharged by the current flowed out to the ground through the activated first discharging constant current circuit 212 and the second discharging constant current circuit 213.

The current amplifier 214 is composed of transistors Q7, Q8, and amplifies the current flowing through the first terminal of the condenser C. A signal amplified by the current amplifier 214 is sent to the waveform extraction circuit 22 as the drive waveform.

The operation of the drive waveform generation circuit 21 now will be described with reference to the timing charts shown in FIGS. 7A to 7E.

Figures 7A, 7B, 7C, 7D, 7E:
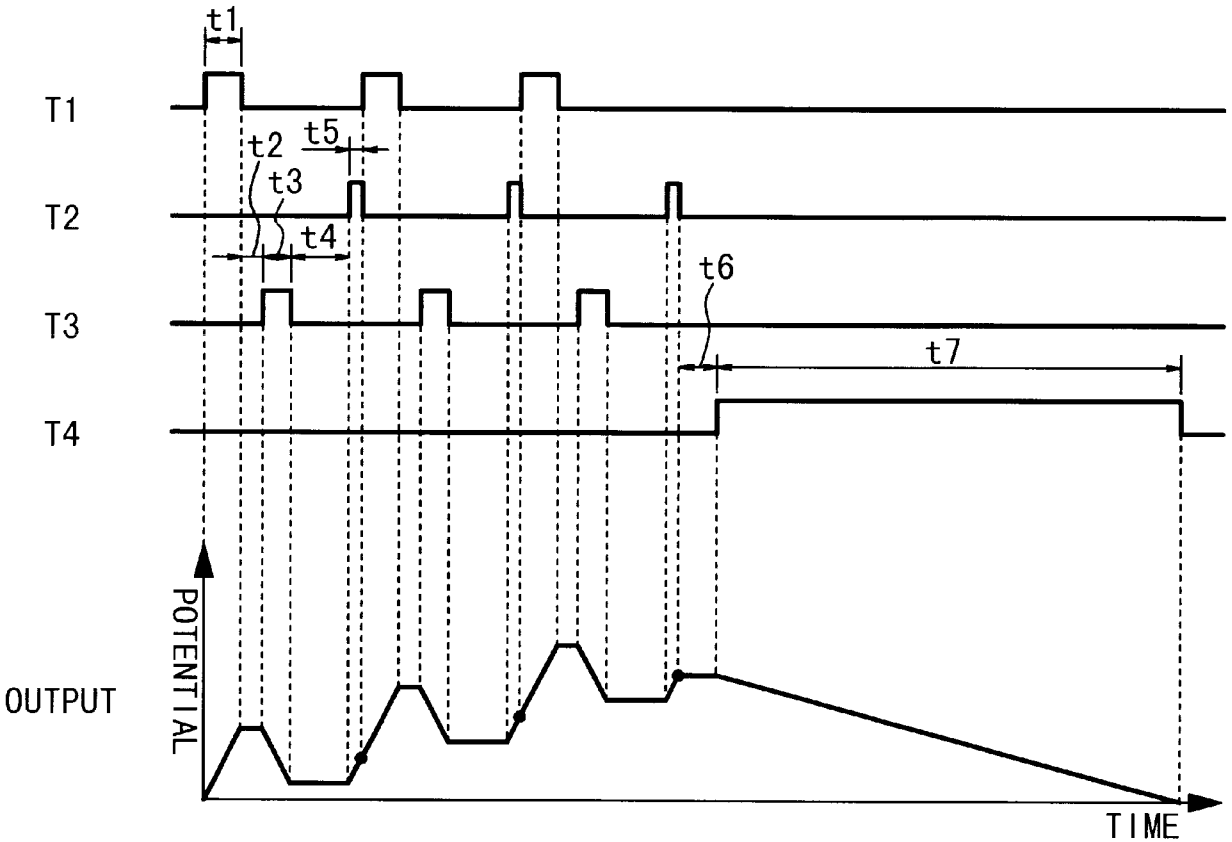
FIGS. 7A to 7E are timing charts describing an operation of the circuit diagram shown in FIG. 6.

As shown in FIG. 7A, a timing generation circuit (not shown) generates a timing signal T1 which is in the H level only for a time period t1 corresponding to a first rising portion of the basic waveform. Also, as shown in FIG. 7C, the timing generation circuit generates a timing signal T3, which rises up after a time period t2 corresponding to a first retaining portion pass from a falling transition edge of the timing signal T1 and retains in the H level only for a time period t3 corresponding to the falling portion. Also, as shown in FIG. 7B, the timing generation circuit generates a timing signal T2, which rises up after a time period t4 corresponding to a second retaining portion pass from a falling transition edge of the timing signal T3, and retains in the H level only for a time period t5 corresponding to the second rising portion. Moreover, as shown in FIG. 7D, the timing generation circuit generates a timing signal T4, which rises up after a time period t6 pass from a falling transition edge of the timing signal T2 corresponding to a third basic waveform and retains in the H level only for a time period t7.

The first charging constant current circuit 210 is activated when the timing signal Ti becomes in the H level, and a current from a power supply +V is outputted through the resistor R10*a* and the transistor Q2*a* to the output terminal To. Accordingly, the condenser C is charged at a speed corresponding to a time constant of a CR circuit formed by the condenser C and the resistor R10*a* in the first charging constant current circuit 210. This charging operation causes a first rising portion having an inclination corresponding to the time constant to be generated as shown in FIG. 7E.

Next, when the timing signal T1 falls down and becomes in a low level (hereafter, referred to as an L level), the output of the current from the first charging constant current circuit 210 is stopped, and the charges accumulated in the condenser C are kept in their original states. This situation is kept until the timing signal T3 becomes in the H level. Accordingly, a first retaining portion is generated for keeping a level of an end of the first rising portion only for the time period t2.

When the timing signal T3 becomes in the H level as shown in FIG. 7C, the first discharging constant current circuit 212 is activated, and the charges accumulated in the condenser C flows through the transistor Q4 and the resistor R20 to the ground. Accordingly, the condenser C is discharged at a speed corresponding to a time constant of a CR circuit formed by the condenser C and the resistor R20 in the first discharging constant current circuit 212. This discharging operation causes a falling portion having an inclination corresponding to the time constant to be generated as shown in FIG. 7E.

When the timing signal T3 falls down and becomes in the L level, the input of the current to the first discharging constant current circuit 212 is stopped, and the charges accumulated in the condenser C are kept in their original states. This situation is kept until the timing signal T2 becomes in the H level. Accordingly, a second retaining portion is generated for keeping a level of an end of the falling portion only for the time period t4.

The second charging constant current circuit 211 is active when the timing signal T2 becomes in the H level, and the current from the power supply +V is outputted through the resistor R10*b* and the transistor Q2*b* to the output terminal To. Accordingly, the condenser C is charged at a speed corresponding to a time constant of a CR circuit formed by the condenser C and the resistor R10*b* in the second charging constant current circuit 211. This charging operation causes a second rising portion having an inclination corresponding to the time constant to be generated as shown in FIG. 7E.

Here, the first charging constant current circuit 210 and the second charging constant current circuit 211 have the same configuration. Thus, those circuits have the same time constant. As a result, the inclination of the first rising portion is equal to that of the second rising portion. In addition, if the inclination of the first rising portion which is different from that of the second rising portion is required, it can be designed that the value of the resistor R10*a* in the first charging constant current circuit 210 is different from that of the resistor R10*b* in the second charging constant current circuit 211.

Next, if the timing signal T2 falls down and becomes in the L level, the input of the current to the first discharging constant current circuit 212 is stopped, and the charges accumulated in the condenser C are kept in their original states. By the way, in the portions corresponding to the first and second basic waveforms, such a control is executed that at the same time when the timing signal T2 falls down and becomes in the L level, the first timing signal Ti rises up and becomes in the H level. As a result, the first rising portion is again generated.

On the other hand, in the portion corresponding to the third basic waveform, a level of an end of the second rising portion is kept until the timing signal T4 becomes in the H level. Accordingly, the level of the end of the second rising portion is kept only for the time period t6. Due to this time period t6, it is possible to avoid the short circuit between the power supply and the ground when the second charging constant current circuit 211 and the second discharging constant current circuit 213 are activated at the same time. It should be noted that the first and second retaining portions also have the function of avoiding the short circuit between the power supply and the ground.

Next, the second discharging constant current circuit 213 is activated when the timing signal T4 becomes in the H level, and the charges accumulated in the condenser C flow out through the transistor Q6 and the resistor R30 to the ground. Accordingly, the condenser C is discharged at a speed corresponding to a time constant of a CR circuit formed by the condenser C and the resistor R30 in the second discharging constant current circuit 213. In this case, as shown in FIG. 7E, the above-mentioned time constant, namely, the value of the resistor R30 is determined such that the charges accumulated in the condenser C for the time periods t1, t2, t3, t4, t5 and t6 are all discharged in a time period t7, in other words, the level of the driving waveform becomes in a head level of the first basic waveform in the time period t7.

The currents flowing to the first terminal of the condenser C by the charging and discharging operations of the condenser C, as mentioned above, are amplified by the current amplifier 214 and sent to the waveform extraction circuit 22 as the drive waveform.

Now will be described the detailed configuration of the waveform extraction circuit 22 with reference to a block diagram shown in FIG. 8. The waveform extraction circuit 22 typically generates a drive signal to drive hundreds of piezoelectric devices. Here, for the purpose of easy illustration, it is assumed that the drive signal is generated to drive four piezoelectric devices 13*a*, 13*b*, 13*c* and 13*d*.

The waveform extraction circuit 22 is composed of a system control circuit 23, shift circuits 24*a*, 24*b*, 24*c* and 24*d*, latch circuits 25*a*, 25*b*, 25*c* and 25*d*, level conversion circuits 26*a*, 26*b*, 26*c* and 26*d*, and switching circuits 27*a*, 27*b*, 27*c* and 27*d*.

The system control circuit 23 controls the driving apparatus 20 as a whole. That is, this system control circuit 23 generates a clock signal to send to the shift circuits 24*a* to 24*d*, and generates a latch signal to send to the latch circuits 25*a* to 25*d*. Also, the circuit 23 sequentially sends a data from outer portion to the shift circuit 24*a* as a print data. Moreover, the circuit 23 generates a start signal of commanding a generation start of a drive waveform, and sends to the drive waveform generation circuit 21.

Each of the shift circuits 24*a* to 24*d* is constituted by, for example, one bit of D type flip-flop. The shift circuit 24*a* stores the print data sent from the system control circuit 23 synchronously with the clock signal. The shift circuits 24*b*, 24*c* and 24*d* respectively store the print data from the shift circuits 24*a*, 24*b* and 24*c* synchronously with the clock signal. Accordingly, the shift circuits 24*a* to 24*d* compose a shift register of four bits for sequentially shifting the print data from the system control circuit 23 synchronously with the clock signal. The print data stored in the respective shift circuits 24*a* to 24*d* are sent to the latch circuits 25*a* to 25*d*, respectively.

The latch circuits 25*a* to 25*d* respectively latch the print data from the shift circuits 24*a* to 24*d* synchronously with the latch signal from the system control circuit 23. The print data latched in the respective latch circuits 25*a* to 25*d* are sent to the level conversion circuits 26*a* to 26*d*, respectively.

Each of the level conversion circuits 26*a* to 26*d* is constituted by an amplifier. The level conversion circuits 26*a* to 26*d* convert levels of signals from the latch circuits 25*a* to 25*d* to send to the switching circuits 27*a* to 27*d*, respectively. Accordingly, gate control signals having a level enough to control the switching circuits 27*a* to 27*d* are sent to switching circuits 27*a* to 27*d*, respectively.

Each of the switching circuits 27*a* to 27*d* is constituted by a gate circuit which is turned on and off in accordance with the gate control signal. The drive waveform from the drive waveform generation circuit 21 is inputted to an input terminal of each of the switching circuits 27*a* to 27*d*. A control signal from each of the level conversion circuits 26*a* to 26*d* is inputted to a gate control terminal. An output terminal of each of the switching circuits 27*a* to 27*d* is connected to a each terminal of the piezoelectric devices 13*a* to 13*d*. Signals from the switching circuits 27*a* to 27*d* are sent to the piezoelectric devices 13*a* to 13*d* as the drive signals, respectively. The other terminal of each of the piezoelectric devices 13*a* to 13*d* is grounded.

Now, the operation of the waveform extraction circuit 22 having the above-mentioned configuration will be described with reference to timing charts shown in FIGS. 9 to 11.

First, a case of a three-mountain drive is described with reference to the timing chart shown in FIGS. 9A to 9G. This three-mountain drive is performed when the system control circuit 23 outputs a significant data (defined as "1" in this embodiment) continuously three times as a print data.

Figures 9A, 9B, 9C, 9D, 9E, 9F, 9G:
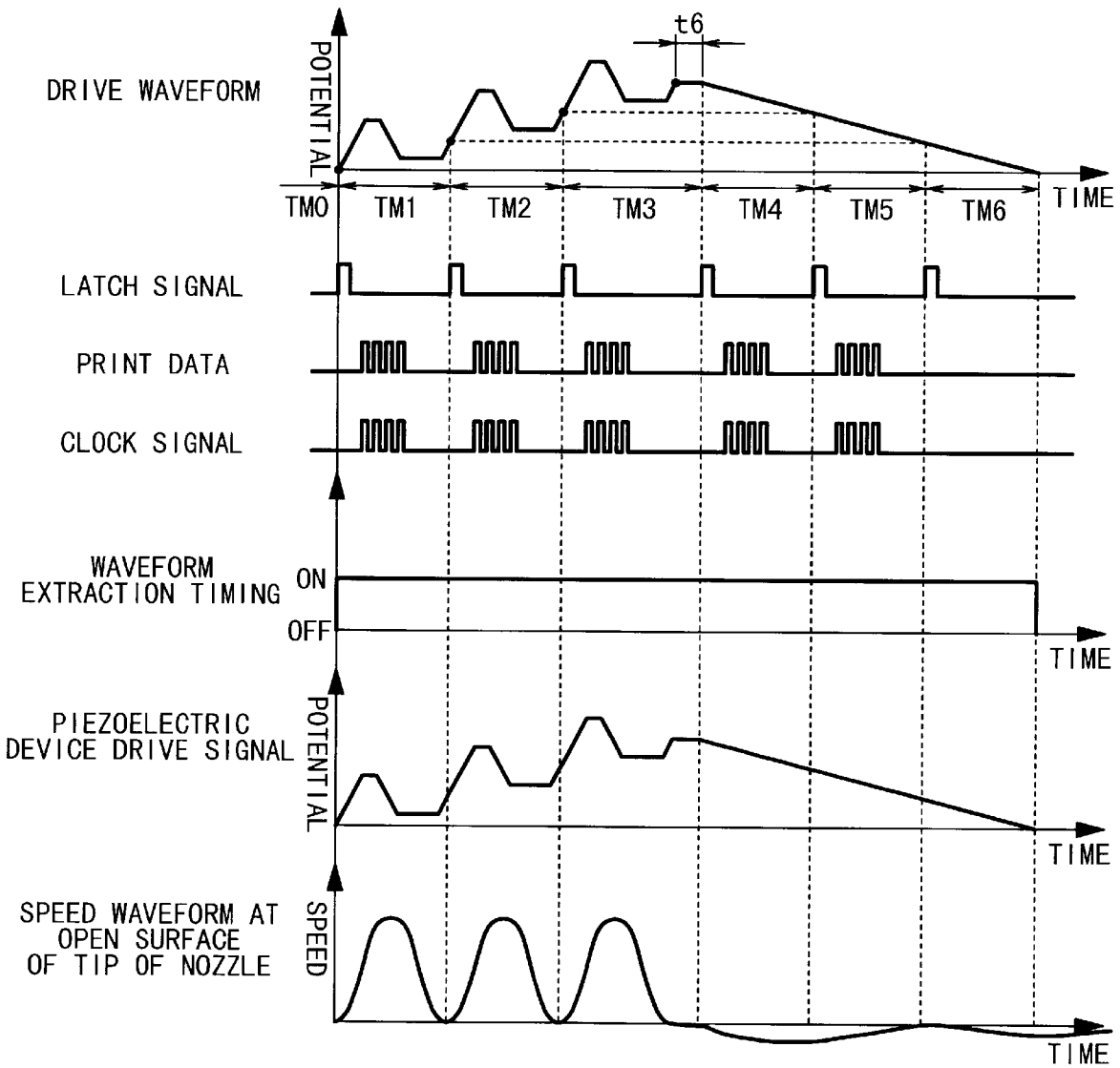
FIGS. 9A to 9G are timing charts describing an operation when three mountains are driven by using a predetermined drive waveform in the apparatus for driving the ink-jet recording head according to the first embodiment of the present invention.

That is, when the system control circuit 23 sequentially outputs "1111B" (hereafter, the final digit "B" denotes a binary numeral) as the print data at a period TM0 as shown in FIG. 9C, the shift circuits 24*a* to 24*d* sequentially shift to receive the print data synchronously with the clock signal, as shown in FIG. 9D. This shift operation is stopped when "1" is stored in all the shift circuits 24*a* to 24*d*.

Next, the system control circuit 23 activates the latch signal (in the H level) at a head of the period TM1, as shown in FIG. 9B. Accordingly, the print data "1" stored in the shift circuits 24*a* to 24*d* are latched in the latch circuits 25*a* to 25*d*, respectively. The signal levels of the data "1" latched in the latch circuits 25*a* to 25*d* are converted to predetermined levels by the level conversion circuits 26*a* to 26*d*, and sent to the switching circuits 27*a* to 27*d*, respectively.

As a result, the respective switching circuits 27*a* to 27*d* are turned on. Then, a drive signal having the same shape as the basic waveform shown in the period TM1 of FIG. 9F is sent to the respective piezoelectric devices 13*a* to 13*d*. This drive signal corresponds to a print drive waveform of the present invention. Accordingly, inks in the open surfaces of the tips of the respective nozzles 10*a* to 10*d* are vibrated in a speed waveform shown in FIG. 9G. Then, a first ink drop 15 is discharged in the vicinity of a skirt of a mountain in this speed waveform.

In the period TM1, in parallel with the above-mentioned output of the drive signal, the system control circuit 23 sequentially outputs "1111B" as a next print data, as shown in FIG. 9C. This print data is received by the shift circuits 24*a* to 24*d*, similarly to the above-mentioned case. Then, the shift operation is stopped in such a state that "1" is stored in all of the shift circuits 24*a* to 24*d*.

Next, the system control circuit 23 activates the latch signal at a head of a period TM2, namely, at an end point of the basic waveform of the period TM1, as shown in FIG. 9B. Accordingly, the respective switching circuits 27*a* to 27*d* are turned on similarly to the case of the period TM1. A drive signal having the same shape as the basic waveform, with the end point of the basic waveform in the period TM1 as a beginning point, is sent to the respective piezoelectric devices 13*a* to 13*d*, as shown in the period TM2 of FIG. 9F. As a result, the inks in the open surfaces at the tips of the respective nozzles 10*a* to 10*d* are vibrated in the speed waveform shown in FIG. 9G. Then, a second ink drop 15 is discharged in the vicinity of the skirt of the mountain in this seed waveform.

In the period TM2, in parallel with the above-mentioned output of the drive signal, the system control circuit 23 sequentially outputs "1111B" as a next print data, as shown in FIG. 9C. This print data is received by the shift circuits 24*a* to 24*d*, similarly to the above-mentioned case. Then, the shift operation is stopped in such a state that "1" is stored in all of the shift circuits 24*a* to 24*d*.

Next, the system control circuit 23 activates the latch signal at a head of a period TM3, namely, at an end point of the basic waveform of the period TM2, as shown in FIG. 9B. Accordingly, the respective switching circuits 27*a* to 27*d* are turned on similarly to the case of the period TM1. A drive signal having the same shape as the basic waveform, with the end point of the basic waveform in the period TM2 as a beginning point, is sent to the respective piezoelectric devices 13*a* to 13*d*, as shown in the period TM3 of FIG. 9F. Accordingly, the inks in the open surfaces at the tips of the respective nozzles 10*a* to 10*d* are vibrated in the speed waveform shown in FIG. 9G. Then, a third ink drop 15 is discharged in the vicinity of the skirt of the mountain in this seed waveform.

In the period TM3, in parallel with the above-mentioned output of the drive signal, the system control circuit 23 sequentially outputs "1111B" as a next print data, as shown in FIG. 9C. This print data is received by the shift circuits 24*a* to 24*d*, similarly to the above-mentioned case. Then, the shift operation is stopped in such a state that "1" is stored in all of the shift circuits 24*a* to 24*d*.

Next, the system control circuit 23 activates the latch signal, after the elapse of a time period t6 from a head of a period TM4, namely, from an end point of the basic waveform of the period TM3, as shown in FIG. 9B. Accordingly, the respective switching circuits 27*a* to 27*d* are turned on similarly to the case of the period TM1. A drive signal which is gradually reducing from the end point of the period TM3, as shown in the period TM4 of FIG. 9F, is sent to the respective piezoelectric devices 13*a* to 13*d*. As a result, the inks in the open surfaces at the tips of the respective nozzles 10*a* to 10*d* are residually vibrated in the speed waveform shown in FIG. 9G. However, the ink drop 15 is never discharged from the respective nozzles 10*a* to 10*d*, in this residual vibration.

The operations in the periods TM5 and TM6 are also equal to that in the period TM4. That is, as shown in FIG. 9F, in the period TM5, a drive signal gradually reducing from an end point of the period TM4, and in the period TM6, a drive signal gradually reducing from an end point of the period TM5 are respectively sent to the respective piezoelectric devices 13a to 13d. As a result, the residual vibration of the speed waveforms of the inks in the open surfaces at the tips of the respective nozzles 10*a* to 10*d* is gradually converged as shown in FIG. 9*g*. Then, the level of the drive signal reaches the level of the beginning point of the period TM1, in the end of the period TM6. Accordingly, one print period is completed.

In this three-mountain drive, the respective switching circuits 27*a* to 27*d* are turned on in all the periods TM1 to TM6. In other words, in the case of the three-mountain drive, the respective switching circuits 27*a* to 27*d* are always turned on so that the drive waveform from the drive waveform generation circuit 21 is sent to the piezoelectric devices 13*a* to 13*d* in its original state. FIG. 9E shows a timing of extracting the waveform. In the case of the three-mountain drive, as shown in FIG. 9E, the waveform is extracted in all portions of the print period.

According to this three-mountain drive, the speed waveform including three mountains is generated as shown in FIG. 9G. As a result, the ink drop is discharged three times. Thereby, the inks equal to three times the amount in a case of a later-described one-mountain drive is discharged. Thus, a large record dot is formed on a print paper. It should be noted that three ink drops can be integrally discharged, if the drive signal so as to make a speed at a valley of the speed waveform shown in FIG. 9G larger is generated by suitably adjusting the shape of the basic waveform. Moreover, the three ink drops can be integrally discharged or separately discharged depending on an ink property and a head shape such as a nozzle diameter and the like.

Now, a case of a two-mountain drive will be described with reference to the timing chart shown in FIGS. 10A to 10B. This two-mountain drive is performed when the system control circuit 23 outputs the significant data "1" continuously two times as the print data.

The operation in a period TM1 is equal to that of the three-mountain drive. That is, a drive signal having the same shape as a basic waveform shown in the period TM1 of FIG. 10F is sent to the respective piezoelectric devices 13*a* to 13*d*. Accordingly, the inks in the open surfaces at the tips of the respective nozzles 10*a* to 10*d* are vibrated in a speed waveform shown in FIG. 10G. Then, a first ink drop 15 is discharged in the vicinity of a skirt of a mountain in this speed waveform.

Figures 10A, 10B, 10C, 10D, 10E, 10F, 10G:
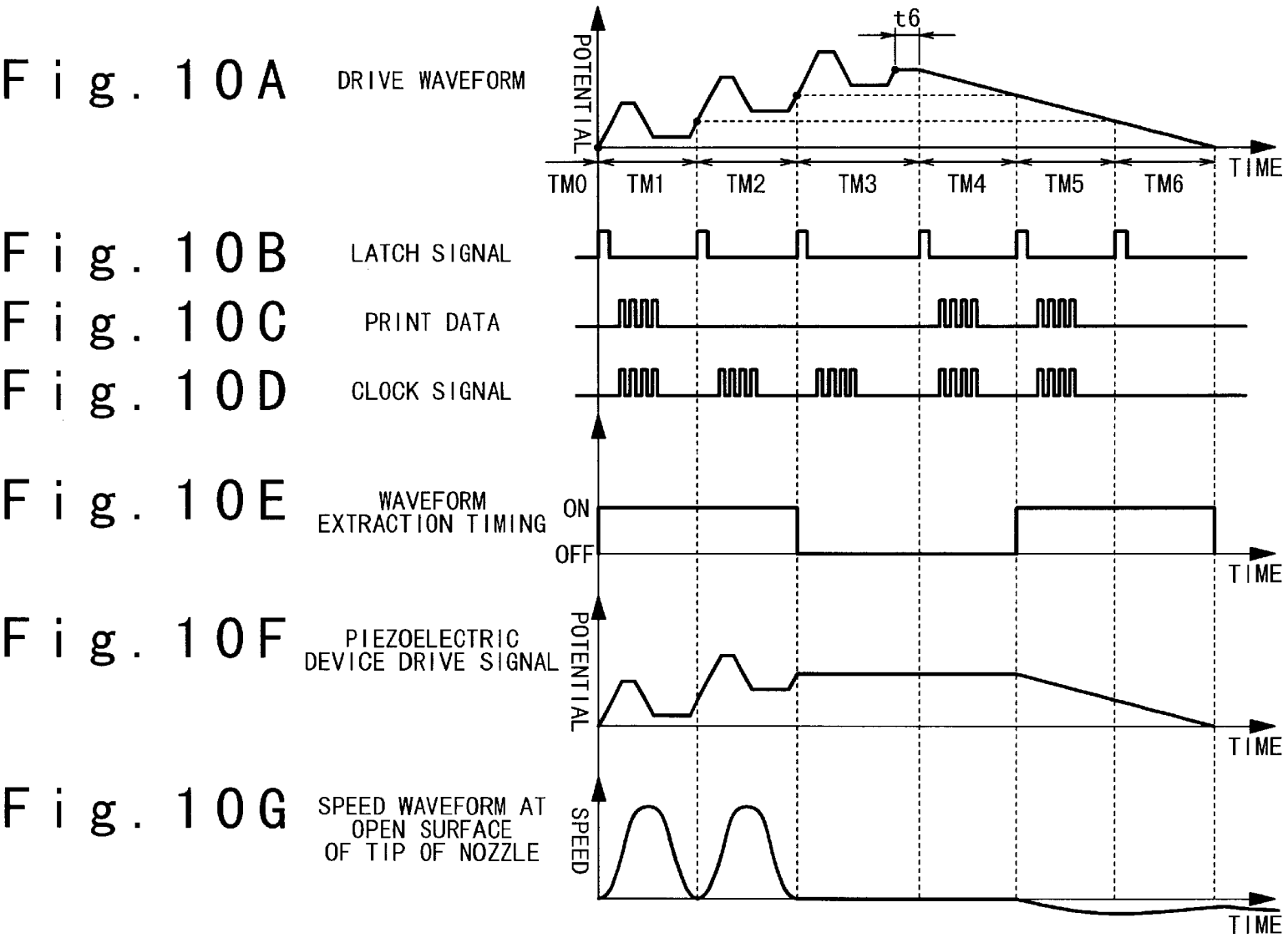
FIGS. 10A to 10G are timing charts describing an operation when two mountains are driven by using a predetermined drive waveform in the apparatus for driving the ink-jet recording head according to the first embodiment of the present invention.

The operation at the period TM2 is equal to that of the case in the three-mountain drive except that the system control circuit 23 sequentially outputs "0000B" as a next print data, as shown in FIG. 10C. That is, a drive signal having the same shape as the basic waveform, with an end point of the basic waveform in the period TM1 as a beginning point, is sent to the respective piezoelectric devices 13a to 13d, as shown in the period TM2 of FIG. 10F. Accordingly, the inks in the open surfaces at the tips of the respective nozzles 10*a* to 10*d* are vibrated in the speed waveform shown in FIG. 10G. Then, a second ink drop 15 is discharged in the vicinity of the skirt of the mountain in this seed waveform.

In this period TM2, in parallel with the above-mentioned output of the drive signal, the system control circuit 23 sequentially outputs "0000B" as a next print data. This print data is received by the shift circuits 24*a* to 24*d*. Then, the shift operation is stopped in such a state that "0" is stored in all of the shift circuits 24*a* to 24*d*.

Next, the system control circuit 23 activates the latch signal at a head of a period TM3, namely, at an end point of the basic waveform of the period TM2, as shown in FIG. 10B. Accordingly, the print data "0" stored in the shift circuits 24*a* to 24*d* are latched by the latch circuits 25*a* to 25*d*. The print data "0" latched in the latch circuits 25*a* to 25*d*, after the signal levels are converted by the level conversion circuits 26*a* to 26*d*, are sent to the switching circuits 27*a* to 27*d*.

As a result, the respective switching circuits 27*a* to 27*d* are turned off, and the drive signal is not sent to the respective piezoelectric devices 13*a* to 13*d*. In this case, the respective piezoelectric devices 13*a* to 13*d* function as a merely capacity device, and keep the signal levels immediately before the respective switching circuits 27*a* to 27*d* are turned off. Accordingly, the level of the end point of the period TM2 is kept as shown in the period TM3 of FIG. 10F. As a result, the inks in the open surfaces at the tips of the respective nozzles 10*a* to 10*d* are not vibrated as shown in the speed waveform shown in FIG. 10G. Thus, the ink drop 15 is not discharged in this period TM3.

In the period TM3, the system control circuit 23 sequentially outputs "0000B" as a next print data, as shown in FIG. 10C. This print data is received by the shift circuits 24*a* to 24*d*. Then, the shift operation is stopped in such a state that "0" is stored in all of the shift circuits 24*a* to 24*d*.

Next, the system control circuit 23 activates the latch signal, after the elapse of the time period t6 from a head of a period TM4, namely, from an end point of the basic waveform of the period TM3, as shown in FIG. 10B. Accordingly, the respective switching circuits 27*a* to 27*d* are turned off similarly to the case of the period TM3. A drive signal for keeping the signal level of the end point of the period TM3 is sent to the respective piezoelectric devices 13*a* to 13*d*, as shown in the period TM4 of FIG. 10F. As a result, the inks in the open surfaces at the tips of the respective nozzles 10*a* to 10*d* are not vibrated as shown in FIG. 10G. Thus, the ink drop 15 is never discharged from the respective piezoelectric devices 13*a* to 13*d*.

The operations in the periods TM5 and TM6 are equal to the case of the three-mountain drive. So, as shown in FIG. 10F, in the period TM5, a drive signal gradually reducing from an end point of the period TM4, and in the period TM6, a drive signal gradually reducing from an end point of the period TM5 are respectively sent to the respective piezoelectric devices 13*a* to 13*d*. As a result, the residual vibration of the speed waveforms of the inks in the open surfaces at the tips of the respective nozzles 10*a* to 10*d* is gradually converged as shown in FIG. 10G. Then, the level of the drive signal reaches the level of the beginning point of the period TM1, in the end of the period TM6. Accordingly, one print period is completed.

In this two-mountain drive, the respective switching circuits 27*a* to 27*d* are turned on when the print data is in "1", namely, in the periods TM1 TM2, TM5 and TM6, as shown in FIG. 10E, and turned off in the periods TM3 and TM4. Thus, only the first and second basic waveforms are extracted among the drive waveforms from the drive waveform generation circuit 21. According to this two-mountain drive, the speed waveform including two mountains is generated as shown in FIG. 10G. As a result, the ink drop is discharged two times. Thereby, the inks equal to two times the amount in the case of a later-described one-mountain drive is discharged. Hence, a record dot of a middle size is formed on the print paper.

Now, a case of one-mountain drive will be described with reference to the timing chart shown in FIGS. 11A to 11B. This one-mountain drive is performed when the system control circuit 23 outputs the significant data "1" only one time as the print data.

The operation at a period TM1 is equal to that of the case in the three-mountain drive except that the system control circuit 23 sequentially outputs "0000B" as a next print data, as shown in FIG. 11C. That is, a drive signal having the same shape as the basic waveform is sent to the respective piezoelectric devices 13*a* to 13*d*, as shown in the period TM1 of FIG. 11F. Accordingly, the inks in the open surfaces at the tips of the respective nozzles 10*a* to 10*d* are vibrated in the speed waveform shown in FIG. 11G. Then, a first ink drop 15 is discharged in the vicinity of the skirt of the mountain in this seed waveform.

The operations in periods TM2 and TM3 are equal to that of the case in the two-mountain drive. In a period TM4, in parallel with the above-mentioned output of the drive signal, the system control circuit 23 sequentially outputs "0000B" as a next print data, as shown in FIG. 11C. This print data is received by the shift circuits 24*a* to 24*d*, similarly to the above-mentioned case. Then, the shift operation is stopped in such a state that "0" is stored in all of the shift circuits 24*a* to 24*d*.

Next, the system control circuit 23 activates the latch signal, after the elapse of a time period t6 from a head of the period TM4, namely, from an end point of the basic waveform of the period TM3, as shown in FIG. 11B. Accordingly, the respective switching circuits 27*a* to 27*d* are turned off similarly to the case of the period TM3. A drive signal for keeping the signal level of the end point of the period TM3 is sent to the respective piezoelectric devices 13*a* to 13*d*, as shown in the period TM4 of FIG. 11F. As a result, the inks in the open surfaces at the tips of the respective nozzles 10*a* to 10*d* are not vibrated as shown in FIG. 11G. Thus, the ink drop 15 is never discharged from the respective piezoelectric devices 13*a* to 13*d*.

The operations in periods TM5 and TM6 are equal to the case of the two-mountain drive. Accordingly, the residual vibration of the speed waveforms of the inks in the open surfaces at the tips of the respective nozzles 10*a* to 10*d* is gradually converged as shown in FIG. 11G. Then, the level of the drive signal reaches the level of the beginning point of the period TM1, in the end of the period TM6. Accordingly, one print period is completed.

In this one-mountain drive, the respective switching circuits 27*a* to 27*d* are turned on when the print data is in "1", namely, in the periods TM1 and TM6, as shown in FIG. 11E, and turned off in the periods TM2 to TM5. Thus, only the first basic waveform is extracted among the drive waveforms from the drive waveform generation circuit 21. According to this one-mountain drive, the speed waveform including one mountain is generated as shown in FIG. 11G. As a result, the ink drop is discharged only one time. Hence, a small record dot is formed on the print paper.

Figures 12A, 12B, 12C, 12D, 12E, 12F, 12G:
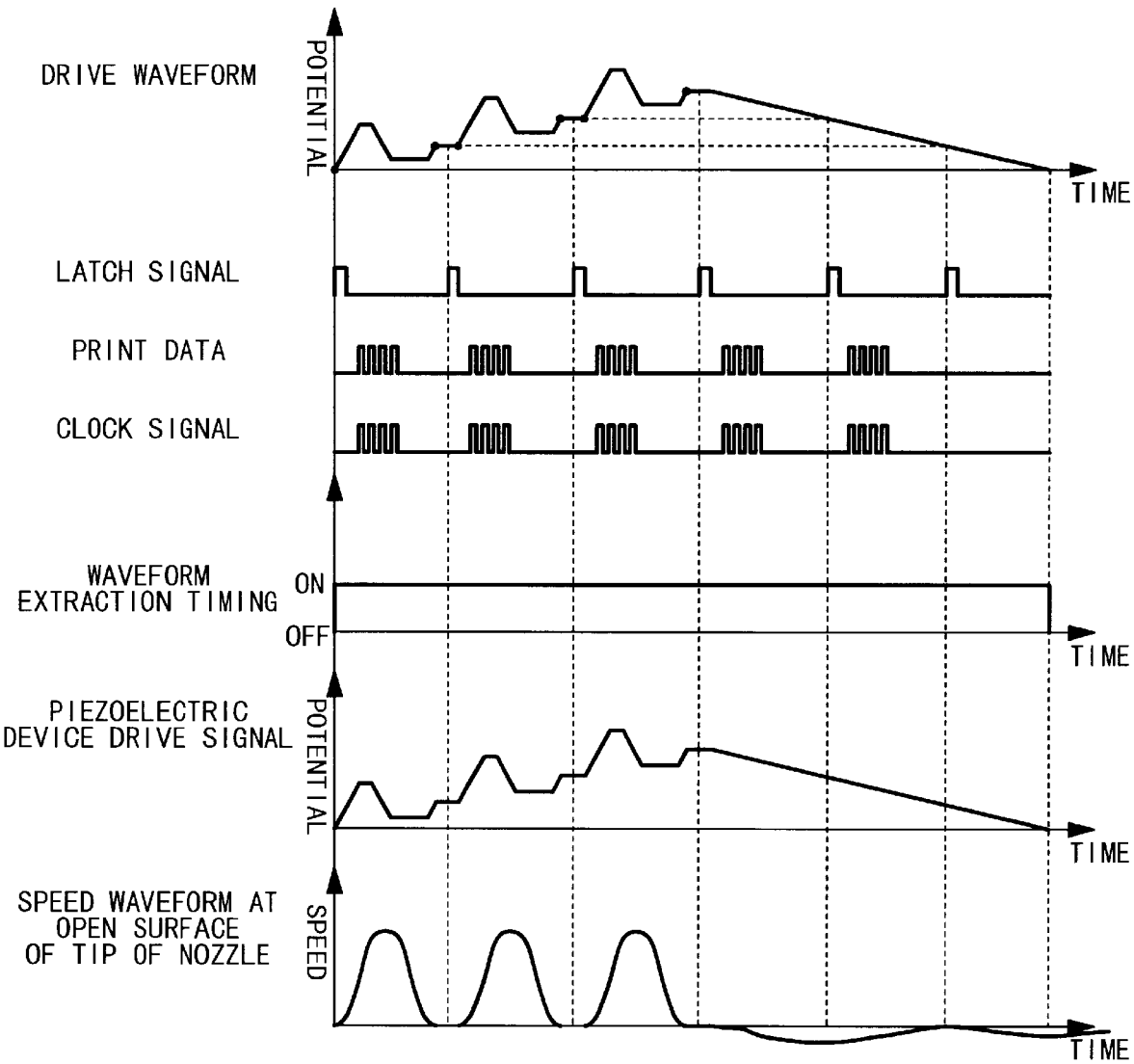
FIGS. 12A to 12G are timing charts describing an operation when three mountains are driven by using another drive waveform in the apparatus for driving the ink-jet recording head according to the first embodiment of the present invention.

In the above-mentioned first embodiment, the drive waveform generation circuit 21 is designed so as to generate the drive waveform in which the beginning point of the second basic waveform is connected to the end point of the first basic waveform, and the beginning point of the third basic waveform is connected to the end point of the second basic waveform. However, as shown in FIG. 12A, the drive waveform may be designed such that its level is kept only for a certain period from the end point of the first basic waveform, and the beginning point of the second basic waveform is connected to an end point of the certain period, and similarly its level is kept only for a certain period from the end point of the second basic waveform, and the beginning point of the third basic waveform is connected to an end point of the certain period. This drive waveform can be generated by suitably adjusting a timing signal sent to the drive waveform generation circuit 21 from a timing signal generation circuit. The driving apparatus 20 functions similarly to the above-mentioned case even when the drive signal is generated on the basis of the drive waveform shown in FIG. 12A to then drive the respective piezoelectric devices 13*a* to 13*d*.

As mentioned above, according to the first embodiment, the number of switching circuits may be equal to that of the piezoelectric devices. Thus, the driving apparatus can be largely miniaturized over the conventional apparatus to also reduce the cost.

Then, the inventor measured the amounts of the ink drops in the several apparatuses for driving the ink-jet recording head, which have the above-mentioned configuration. So, the measured results will be described below. The amounts of the ink drops discharged from the respective piezoelectric devices 13*a* to 13*d* when the drive signal is sent from the driving apparatus 20 through the respective switching circuits 27*a* to 27*d* to the respective piezoelectric devices 13*a* to 13*d* are different depending on the structure and shape of the ink-jet recording head and the drive waveform.

A first measurement used an ink having a viscosity of $3.3\times10^{-3}$ Pa·s in an ink-jet recording head in which a period Tc peculiar to an ink flow path was 10.4 $\mu$s, a volume change of a pressure room caused by a piezoelectric device was $2.3\times10^{-15}$ $m^3$/V, a nozzle had an R-shaped section with a diameter of 24 $\mu$m and a length of 70 $\mu$m, and a supply port had an R-shaped section with a diameter of 27 $\mu$m and a length of 70 $\mu$m. Its basic waveform was generated such that t1=1.04 $\mu$s, t2=0.31 $\mu$s, t3=1.04 $\mu$s, t4=0.83 $\mu$s, t5=0.69 $\mu$s, V1=V2=8.6 V and V3=5.6 V.

Under this condition, an ink drop amount of $15\times10^{-15}$ $m^3$ was discharged when the drive waveform of the three-mountain was applied as shown in FIG. 9A, an ink drop amount of $10\times10^{-15}m^3$ was discharged when the drive waveform of the two-mountain was applied as shown in FIG. 10A, and an ink drop amount of $5\times10^{-15}m^3$ was discharged when the drive waveform of the one-mountain was applied as shown in FIG. 11A. The speeds of the discharged ink drops were all about 4 m/s.

Also, a temporal difference between the discharges of a first drop and a third drop was 7.82 $\mu$s. When a dot pitch was 720 dot/inch (=35 $\mu$m), a drive frequency was 14.4 kHz, and a distance between a nozzle and a print paper was 1 mm, a deposition location deviation between the first drop and the third drop was only 4 $\mu$m. Thus, the quality of print is extremely improved over the conventional technique.

Various basic waveforms different in shape were prepared. Then, the drive waveforms shown in FIGS. 9A, 10A and 11A were generated about each basic waveform and applied to the piezoelectric devices. FIG. 13 shows the result of the amounts of the discharged ink drops. As shown in FIG. 13, such a fact was confirmed that when the time period t1 of the first rising portion of the basic waveform and the time period t3 of the falling portion, which largely contribute to the amount of the discharged ink drops, are respectively equal to or less than 0.4 times the period Tc peculiar to the ink flow path, the amounts of the discharged ink drops can be discharged at a ratio of 3:2:1.

Next, a second measurement used an ink having a viscosity of $3.3\times10^{-3}$ Pa·s in an ink-jet recording head in which a period Tc peculiar to an ink flow path was 12.5 $\mu$s, a volume change of a pressure room caused by a piezoelectric device was $1.6\times10^{-15}$ $m^3$/V, a nozzle had an R-shaped section with a diameter of 29 $\mu$m and a length of 70 $\mu$m, and a supply port had an R-shaped section with a diameter of 31 $\mu$m and a length of 70 $\mu$m. In this case, if t1/Tc=0.1, t2/Tc=0.03, t3/Tc=0.1, t4/Tc=0.08, and t5/Tc=0.066 are applied in the condition No. "1" of FIG. 13, the basic waveform was generated such that t1=1.25 $\mu$s, t2=0.38 $\mu$s, t3=1.25 $\mu$s, t4=1 $\mu$s, t5=0.83 $\mu$s, V1=V2=18.7 V, and V3=12.3 V.

Under this condition, an ink drop amount of $27\times10^{-15}m^3$ was discharged when the drive waveform of the three-mountain was applied as shown in FIG. 9A, an ink drop amount of $18\times10^{-15}m^3$ was discharged when the drive waveform of the two-mountain was applied as shown in FIG. 10A, and an ink drop amount of $9\times10^{-15}m^3$ was discharged when the drive waveform of the one-mountain was applied as shown in FIG. 11A. Also, the speeds of the discharged ink drops were all about 4 m/s.

In the above-mentioned description, it is designed so as to generate the drive waveform by using the basic waveform in which the residual vibration is not substantially induced. This is because its control is easy. That is, since such a basic waveform is used, the shape of the first mountain in the speed waveform of the meniscus at the tip of the nozzle becomes substantially equal to those on and after the second mountain. Also, the speeds of the ink drops become equal irrespectively of the amounts of the discharged ink drops. Moreover, the amounts of the discharged ink drops become integer times.

Figure 14A:
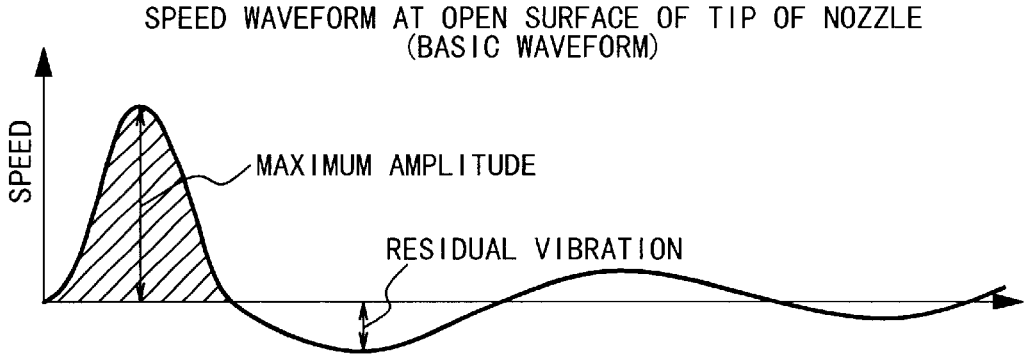
FIGS. 14A and 14B are waveform views showing a speed waveform of meniscus when a residual vibration is induced on a minus side, in the apparatus for driving the ink-jet recording head according to the first embodiment of the present invention.

However, if a plurality of mountains can be generated in the speed waveform of the meniscus at the tip of the nozzle, the driving apparatus can be also constituted by using the basic waveform in which the residual vibration is induced. FIG. 14A shows an example of a speed waveform of meniscus, in which the residual is induced on a minus side, when the piezoelectric device is driven by the drive signal on the basis of the basic waveform.

Figure 14B:
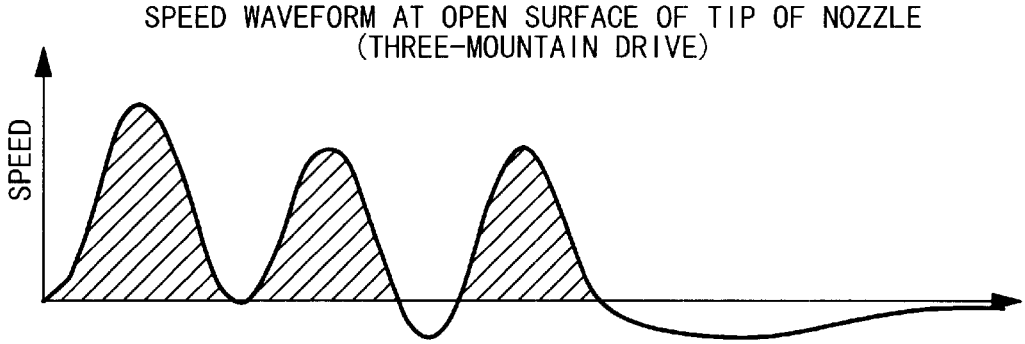

A speed waveform of meniscus shown in FIG. 14B can be obtained when above mentioned basic waveform is used to generate the drive signal for the three-mountain drive to then drive the piezoelectric device. Thus, the operation of the ink-jet recording head is carried out substantially equal to that of the case of using the basic waveform in which the residual vibration is not substantially induced. Incidentally, if amplitude of the residual vibration is too large, a distortion of the speed waveform in the ink meniscus becomes large when the three-mountain drive is performed, which brings about an operation error of the ink-jet recording head. Hence, it is desirable to use the basic waveform in which the amplitude of the residual vibration is equal to or less than 30% of the maximum amplitude.

Figure 15A:
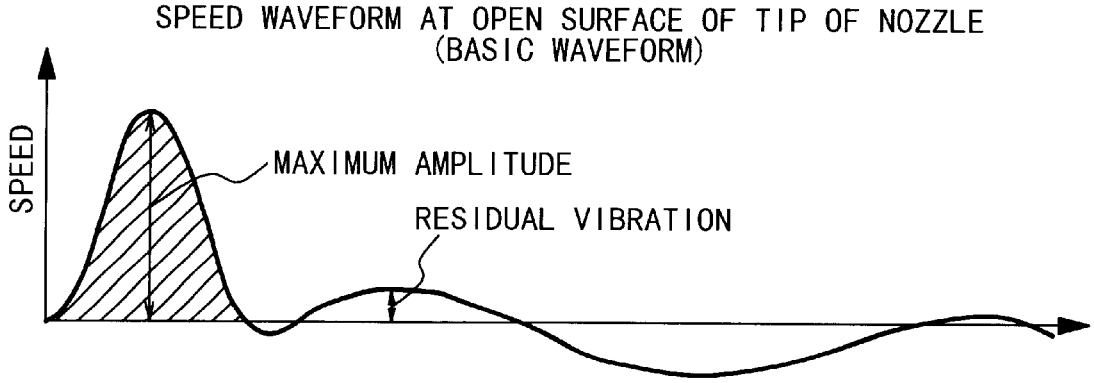
FIGS. 15A and 15B are waveform views showing an example of a speed waveform of meniscus when a residual vibration is induced on a plus side, in the apparatus for driving the ink-jet recording head according to the first embodiment of the present invention.
Figure 15B:
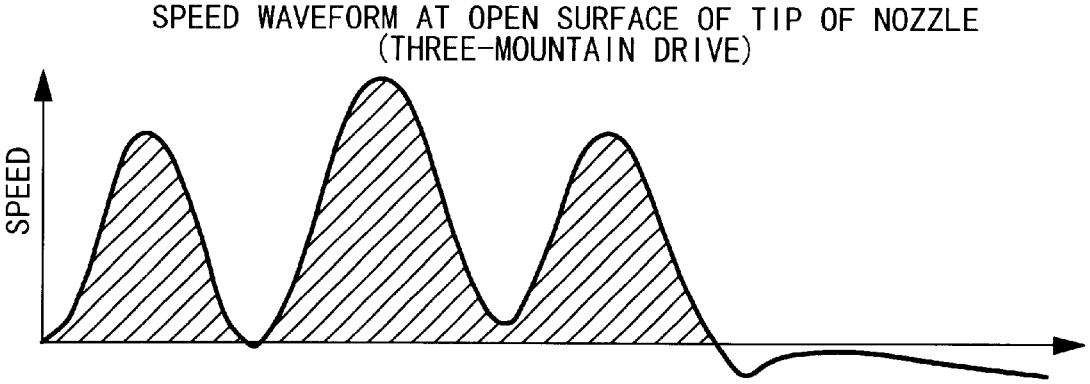

FIG. 15A shows an example of a speed waveform of meniscus, in which the residual is induced on a plus side, when the piezoelectric device is driven by the drive signal on the basis of the basic waveform. A speed waveform of meniscus shown in FIG. 15B can be obtained when above mentioned basic waveform is used to generate the drive signal for the three-mountain drive to then drive the piezoelectric device. Thus, the operation of the ink-jet recording head is carried out substantially equal to that of the case of using the basic waveform in which the residual vibration is not substantially induced. Incidentally, if the amplitude of the residual vibration is too large, the distortion of the speed waveform in the ink meniscus becomes large when the three-mountain drive is performed, which brings about the operation error of the ink-jet recording head. Hence, it is desirable to use the basic waveform in which the amplitude of the residual vibration is equal to or less than 30% of the maximum amplitude.

In the above-mentioned first embodiment, the piezoelectric device of the lamination type shown in FIG. 1 is used as the ink-jet recording head. However, the present invention is not limited to the ink-jet recording head employing the piezoelectric device of the lamination type. The present invention can be applied to an ink-jet recording head employing a piezoelectric device of a single plate type shown in FIG. 16.

Figure 16:
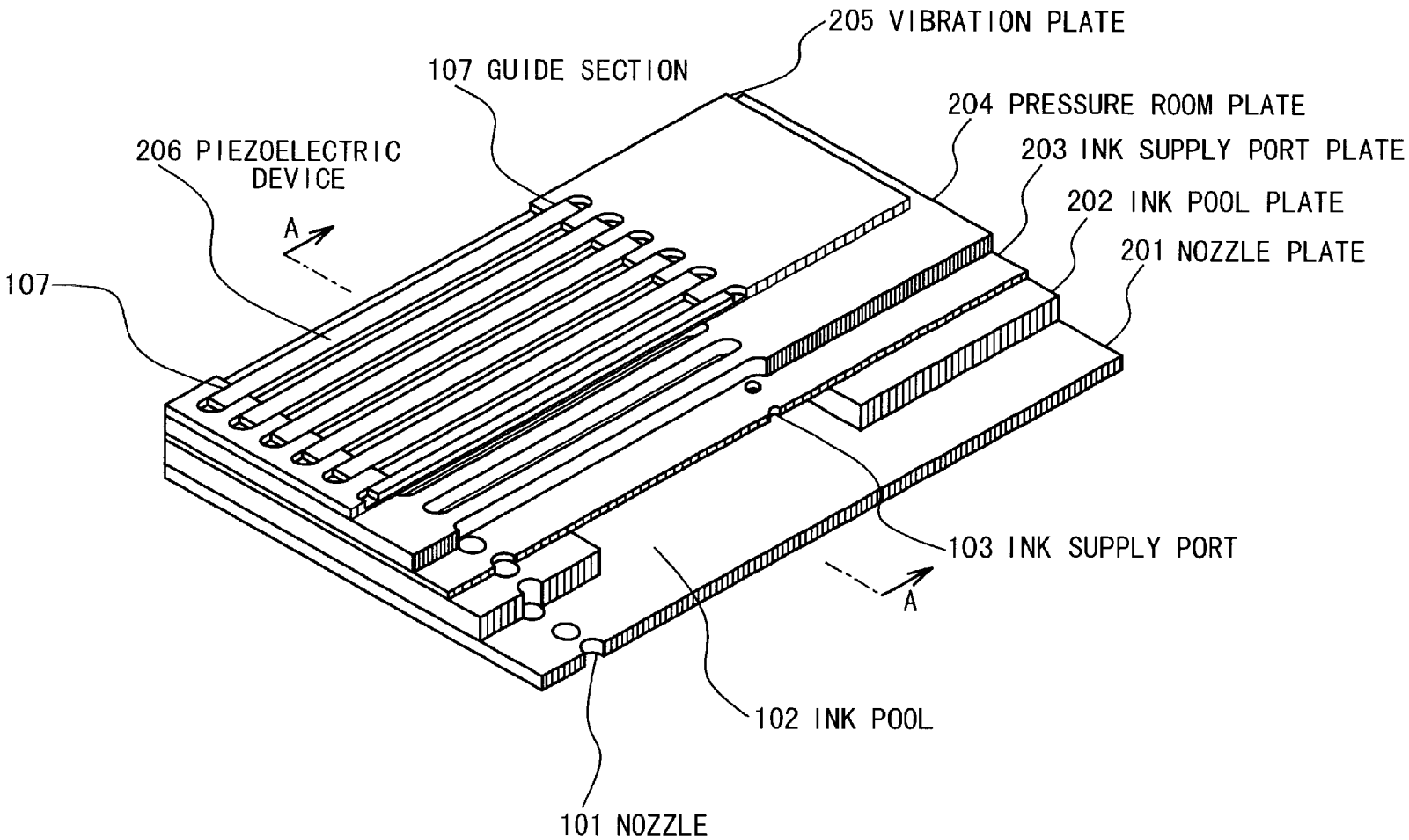
FIG. 16 is a view showing a mechanic configuration of another ink-jet recording head to which the driving apparatus according to the first embodiment of the present invention is applied.

FIG. 16 shows an example of the ink-jet recording head employing the piezoelectric device of the single plate type. This ink-jet recording head is constituted by laminating and joining a nozzle plate 201 for forming a nozzle 101, an ink pool plate 202 for forming an ink pool, a ink supply plate 203 for forming an ink supply port 103, a pressure room plate 204 for forming a pressure room 104, a vibration plate 205 and a piezoelectric device 206.

On the vibration plate 205, a guide section 107 for positioning the piezoelectric device 206 is formed on portions except a range in contact with the pressure room 104. The piezoelectric device 206 positioned by this guide section 107 is joined on the vibration plate 205. It should be noted that this ink-jet recording head is provided with an electrical signal line to send an electrical signal to the piezoelectric device 206, and an ink flow path to fill the ink in the ink pool 102 through an ink suck port. However, it is omitted in FIG. 16.

Figure 17:
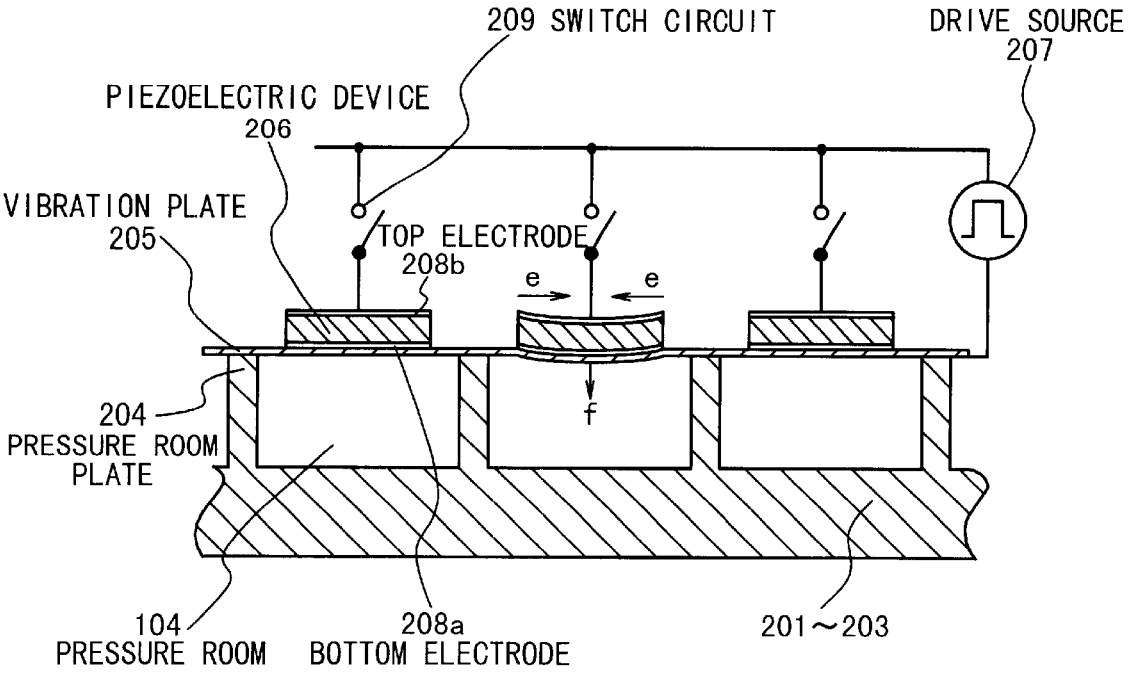
FIG. 17 is a view describing an operation of the ink-jet recording head shown in FIG. 16.

The operation according to UNIMOLF effect of the piezoelectric device 206 and the vibration plate 205 with regard to the ink-jet recording head having the above-mentioned configuration will be described below with reference to FIG. 17. FIG. 17 is a section view taken on the line A—A of FIG. 16. The piezoelectric device 206 is mounted on the vibration plate 205, in response to each pressure room 104. In this piezoelectric device 206, a bottom electrode 208*a* is created on a side joined to the vibration plate 205, and a top electrode 208*b* is created on a side opposite thereto, respectively. Here, polarization of the piezoelectric device 206 is caused in a direction from the side of the top electrode 208*b* to the side of the bottom electrode 208*a* (allowable even in the opposite direction). The bottom electrode 208*a* is electrically connected to the vibration plate 205. The vibration plate 205 functions as a common electrode section to which a plurality of the bottom electrodes 208*a* on the piezoelectric devices 206 is connect, and connected to a terminal of a drive source 207.

Also, the top electrode 208b is connected to another terminal of the drive source 207 through a switch circuit 209 for turning on and off the electrical connection for each piezoelectric device. If a print command is inputted from a controller (not shown), the switch circuit 209 is turned on so that a voltage from the drive source 207 is applied to the piezoelectric device 206. Thus, the piezoelectric device 206 is contracted to a direction of "e" of FIG. 17, due to the piezoelectric effect. However, the side of the piezoelectric device 206, joined to the vibration plate 205, is smaller in distortion than the opposite side, because of a load based on the vibration plate 205. This distortion asymmetry causes the joined portion between the piezoelectric device 206 and the vibration plate 205 to be deformed in a direction "f" of FIG. 17. Accordingly, the volume within the pressure room 104 is contracted and compressed.

The drive signal from the drive source 207 corresponding to the above-mentioned driving apparatus 20 is supplied to the ink-jet recording head having the above-mentioned configuration. Thereby, an operation similar to the above-mentioned operation is carried out and accordingly is controlled the discharge of the inks from the nozzle 101.

(Second Embodiment)

A second embodiment of the present invention now will be described. A driving apparatus according to the second embodiment drives an ink-jet recording head of a so-called pull and hit type that expands and then contracts a pressure room in which ink is contained. As this ink-jet recording head a print head can be used which is disclosed in Japanese Laid Open Patent Application (JP-A-Heisei 10-81012).

Figure 18:
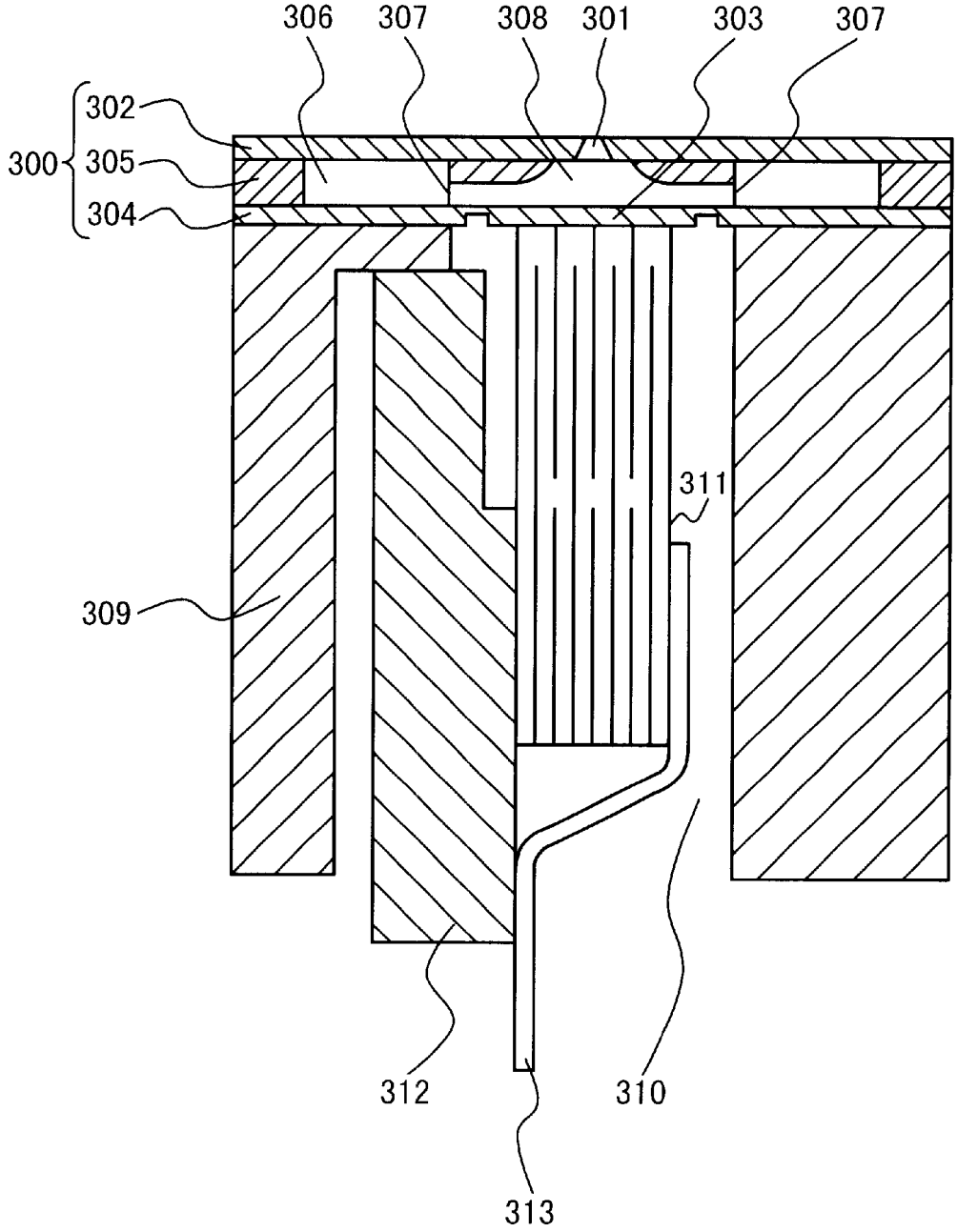
FIG. 18 is a view showing a mechanic configuration of a print head to which a driving apparatus according to a second embodiment of the present invention is applied.

FIG. 18 shows the mechanical structure of this print head. A substrate unit 300 is constituted by sandwiching a flow path generation plate 305 between a nozzle plate 302 on which a nozzle hole 301 is formed and a vibration plate 304 on which an island portion 303 is formed. An ink room 306, an ink supply port 307 and a pressure generation room 308 are formed on the flow path generation plate 305.

An accommodation room 310 is formed on a base 309. A piezoelectric vibrator 311 is mounted within the accommodation room 310. The piezoelectric vibrator 311 is fixed through a fixed substrate 312 so that a tip of the piezoelectric vibrator 311 is in contact with the island portion 803. Here, PZT, which shows longitudinal vibration and lateral vibration effect, is used for the piezoelectric vibrator 311. The PZT is contracted when charging, and is expanded when discharging. The charge to and discharge from the piezoelectric vibrator 311 are done through a lead 313.

If the piezoelectric vibrator 311 is charged, the piezoelectric vibrator 311 is contracted to thereby expand the pressure generation room 308 and also reduce a pressure within the pressure generation room 308. Thus, ink flows from the ink room 306 into the pressure generation room 308. If the piezoelectric vibrator 311 is discharged, the piezoelectric vibrator 311 is extended to thereby contract the pressure generation room 308 and also increase the pressure within the pressure generation room 308. Hence, the ink within the pressure generation room 308 is discharged through a nozzle hole 301 to outer portion.

In the driving apparatus according to the second embodiment, the shape of the drive signal generated by the driving apparatus is different from that of the drive signal generated by the driving apparatus according to the first embodiment. Actually, the configuration of the drive waveform generation circuit included in the driving apparatus according to the second embodiment is different from that of the drive waveform generation circuit included in the driving apparatus according to the first embodiment.

Figure 19A:
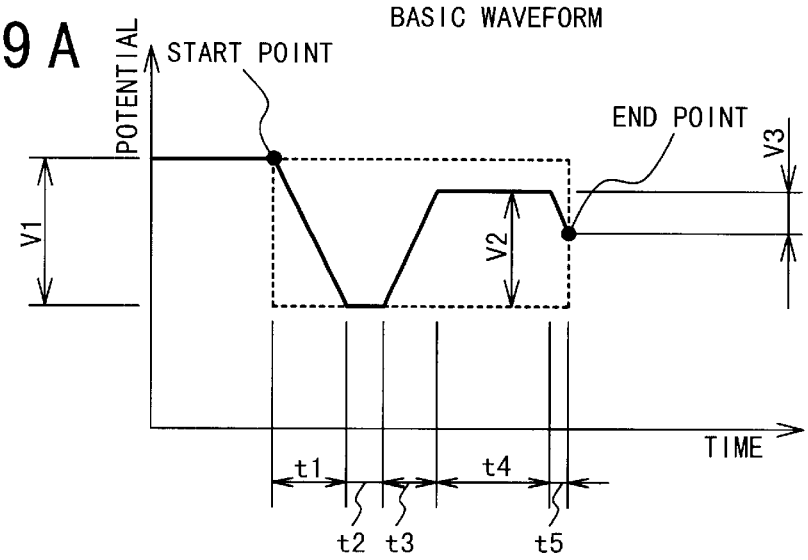
FIGS. 19A to 19C are waveform views showing an example of a basic waveform included in a drive waveform used in the apparatus for driving the ink-jet recording head according to the second embodiment of the present invention.

A basic waveform used in this second embodiment will be described below. The basic waveform is composed of a first falling portion, a first retaining portion following this first falling portion, a rising portion following this first retaining portion, a second retaining portion following this rising portion, and a second falling portion following this second retaining portion, as shown in FIG. 19A. Each has time periods t1, t2, t3, t4 and t5. A potential difference at the first falling portion is V1, a potential difference at the rising portion is V2, and a potential difference at the second falling portion is V3.

Figure 19B:
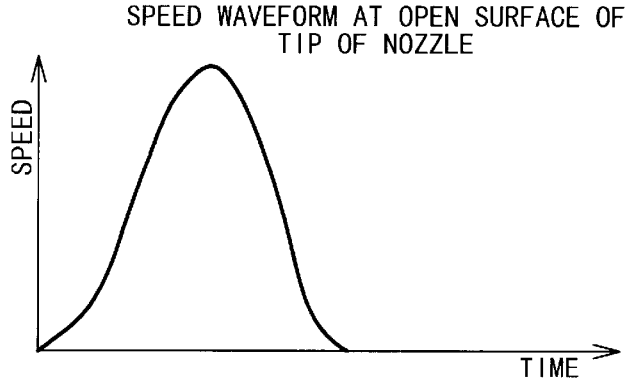
Figure 19C:
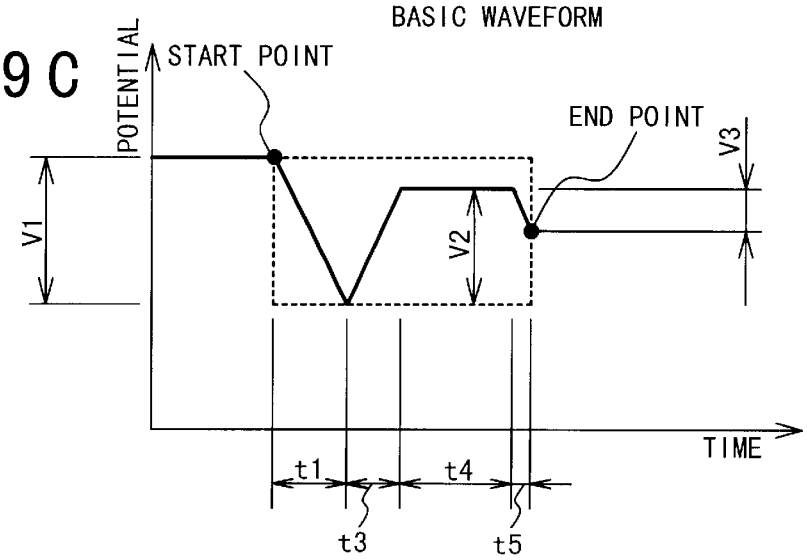

This basic waveform can be generated in accordance with the period Tc peculiar to the ink flow path, similarly to the first embodiment. It was confirmed that when such a basic waveform was sent to the piezoelectric device of the ink-jet recording head to then determine a speed waveform of an ink meniscus in an open surface of a nozzle tip, the residual vibration was not substantially induced after the generation of a speed waveform of one-mountain, as shown in FIG. 19B. Also, it was confirmed that the result in which an area of a mountain of the speed waveform is multiplied by an area of the open surface of the nozzle tip becomes equal to an amount of discharged ink drops. Also, a waveform in which the time period t2 is zero can be used as the basic waveform, as shown in FIG. 19C.

Figure 20A:
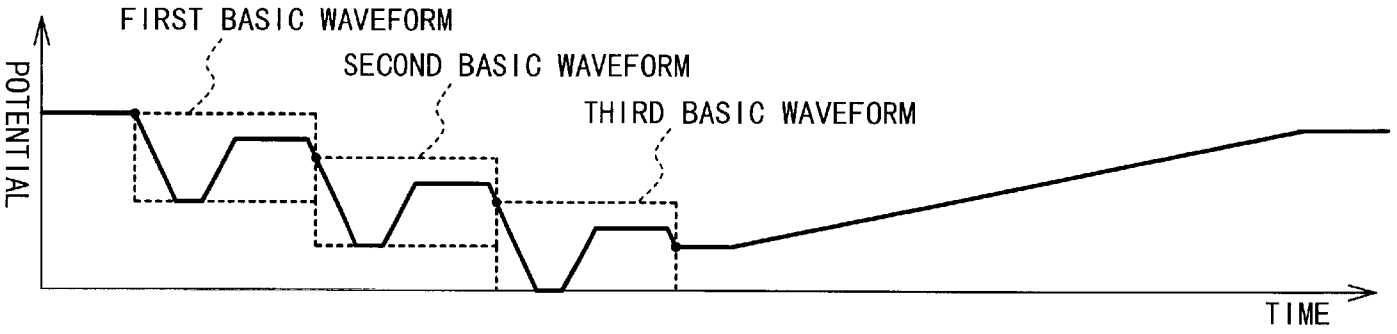
FIGS. 20A and 20B are waveform views showing an example of a drive waveform to drive a piezoelectric device used in the apparatus for driving the ink-jet recording head according to the second embodiment of the present invention.
Figure 20B:
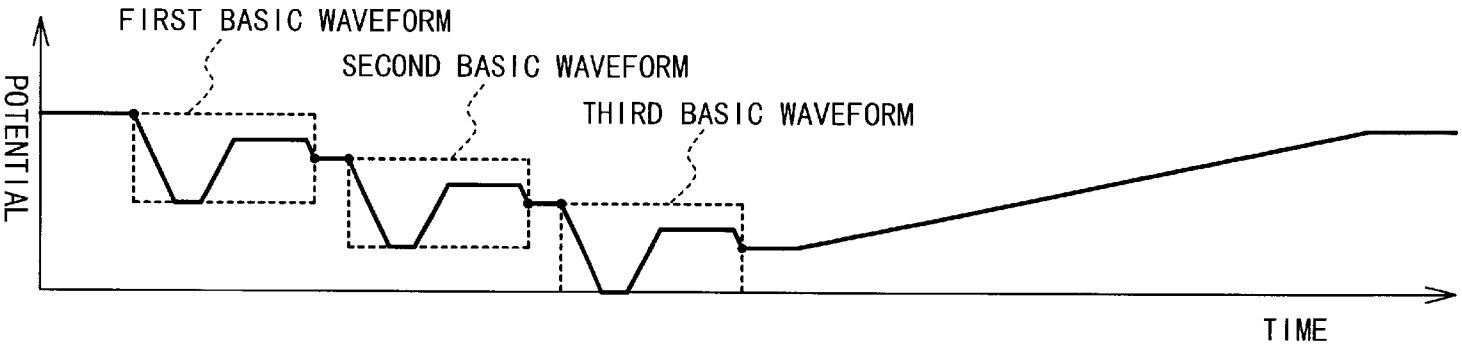

The drive waveform is generated by connecting a plurality of above-mentioned basic waveforms. This drive waveform has a shape as shown in FIG. 20A. That is, a beginning point of a second basic waveform is connected to an end point of a first basic waveform. A beginning point of a third basic waveform is connected to an end point of the second basic waveform. Then, it rises up to a voltage at the beginning point of the first basic waveform, after an elapse of a certain period, from the end point of the third basic waveform. Also, the drive waveform may have the shape shown in FIG. 20B. That is, an end point of the first basic waveform is connected to a beginning point of the first retaining portion for retaining a level of the end point. An end point of the first retaining portion is connected to a beginning point of the second basic waveform. An end point of the second basic waveform is connected to a beginning point of the second retaining portion for retaining a level of the end point. An end point of the second retaining portion is connected to a beginning point of the third basic waveform. Also, it rises up to a voltage of the beginning point of the first basic waveform, after an elapse of a certain period, from the end point of the third basic waveform. Incidentally, in this second embodiment, the three basic waveforms are used to constitute the drive waveform. However, the number of basic waveforms is not limited to 3, and it may be arbitrarily determined.

Figure 6:
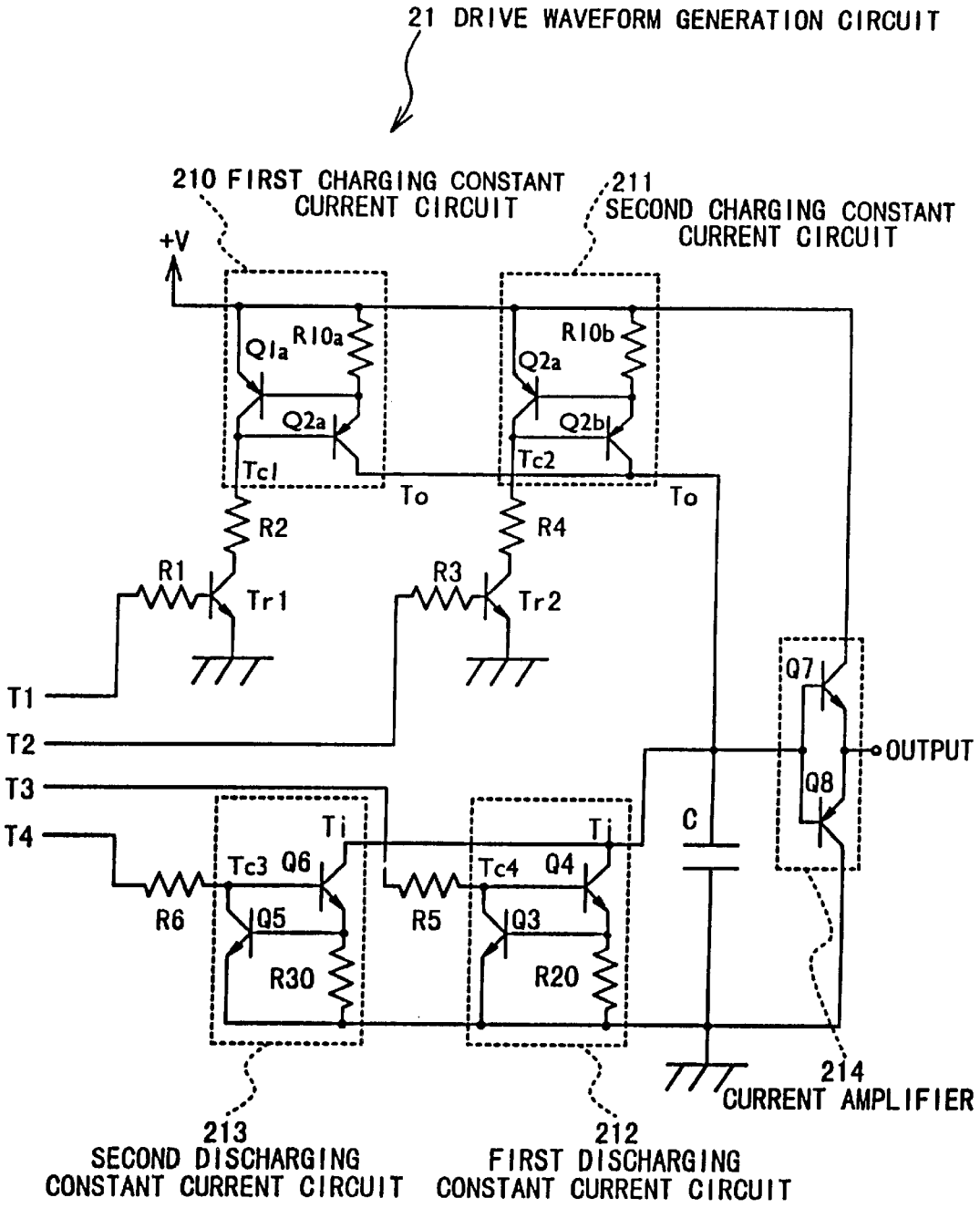
FIG. 6 is a circuit diagram showing a configuration of a drive waveform generation circuit of the apparatus for driving the ink-jet recording head according to the first embodiment of the present invention.
Figure 8:
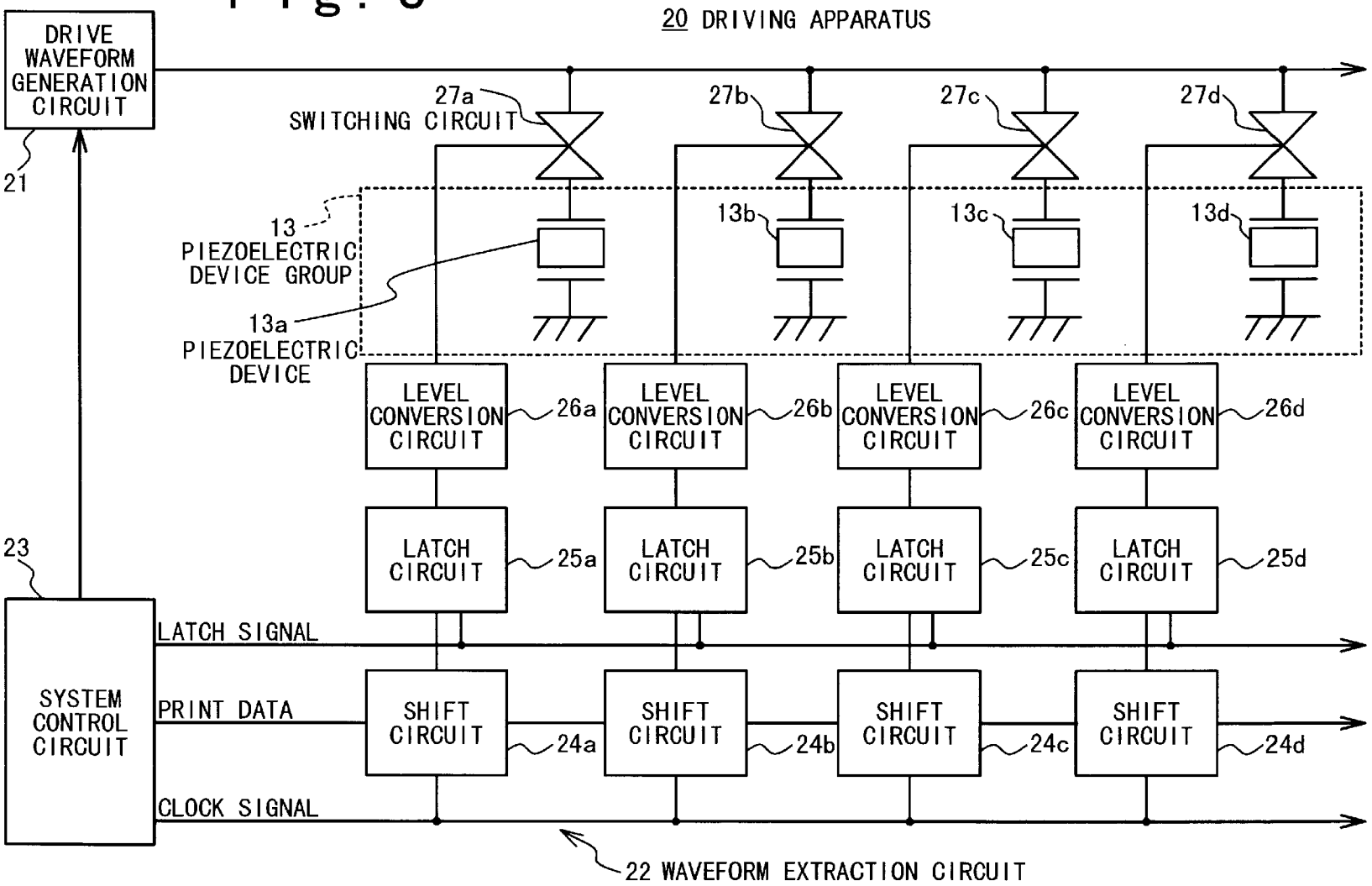
FIG. 8 is a block diagram showing a configuration of a waveform extraction circuit of the apparatus for driving the ink-jet recording head according to the first embodiment of the present invention.

The drive waveform generation circuit for generating above described drive waveform can be air constituted by using the circuit similar to that shown in FIG. 6, and a waveform extraction circuit can be used by using that shown in FIG. 8 in its original state. Also, the operation of the driving apparatus according to this second embodiment is identical to that of the driving apparatus according to the first embodiment except that the drive waveform shown in FIG. 9A and FIG. 12A are changed into the waveforms shown in FIG. 20A and FIG. 20B, respectively.

According to the driving apparatus of the ink-jet recording head according to this second embodiment, the print speed can be improved even for the ink-jet recording head of the pull and hit type. Moreover, the amount of the ink drops discharged from the nozzle can be controlled so as to improve the quality of print.

In addition, in this second embodiment and the above-mentioned first embodiment, it is possible to provide the similar effect even if using an actuator which can cause a pressure variation within a pressure room in accordance with a externally supplied signal, such as an electrical distortion device which deviates proportional to a square of a voltage and a magnetic distortion device which deviates in a magnetic field, instead of the piezoelectric device.

As detailed above, the present invention can provide the apparatus for and the method of driving the ink-jet recording head, which are small and cheap and can control the amount of the ink drops discharged from the nozzle so as to make the print speed faster and also improve the quality of print.

What is claimed is:

1. An apparatus for driving an ink-jet recording head comprising:

a piezoelectric device;

a drive waveform generation circuit which generates a drive waveform in which n basic waveforms are connected in series, each of said n basic waveforms having a single period, where n is an integer equal to or greater than 2; and a waveform extraction circuit which extracts m (m is an integer, and $0 \leqq m \leqq n$) of said n basic waveforms as a print drive waveform based on an externally supplied print data, and applies said print drive waveform to said piezoelectric device, wherein an ink is discharged from a nozzle based on a distortion of said piezoelectric device, wherein said drive waveform generation circuit comprises a current amplifier for outputting an amplified signal as said drive waveform, and wherein the drive waveform generated by said drive waveform generation circuit has a first portion, in which a level of an end point in an i-th basic waveform (i is an integer equal to or greater than 1, and $i<n$) is equal to and connected to a level of a beginning point in an (i+1) -th basic waveform.

2. An apparatus for driving an ink-jet recording head according to claim 1, wherein said basic waveform is formed such that an amplitude of a residual vibration of an ink meniscus at a tip portion of said nozzle is equal to or less than 30% of a maximum amplitude of said ink meniscus vibration of said nozzle, when said basic waveform is supplied to said piezoelectric device.

3. An apparatus for driving an ink-jet recording head according to claim 1, wherein said basic waveform has a first rising portion rising from a predetermined level to a first level, a first retaining portion retaining said first level, a falling portion falling down from said first level to a second level, a second retaining portion retaining said second level, and a second rising portion rising from said second level to a third level.

4. An apparatus for driving an ink-jet recording head according to claim 3, wherein an inclination of said first rising portion of said basic waveform is equal to an inclination of said second rising portion.

5. An apparatus for driving an ink-jet recording head according to claim 3, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

6. An apparatus for driving an ink-jet recording head according to claim 1, wherein said basic waveform has a first rising portion rising from a predetermined level to a first level, a falling portion falling down from said first level to a second level, a retaining portion retaining said second level, and a second rising portion rising from said second level to a third level.

7. An apparatus for driving an ink-jet recording head according to claim 1, wherein said basic waveform has a first falling portion falling down from a predetermined level to a first level, a first retaining portion retaining said first level, a rising portion rising from said first level to a second level, a second retaining portion retaining said second level, and a second falling portion falling down from said second level to a third level.

8. An apparatus for driving an ink-jet recording head according to claim 7, wherein an inclination of said first falling portion of said basic waveform is equal to an inclination of said second falling portion.

9. An apparatus for driving an ink-jet recording head according to claim 7, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

10. An apparatus for driving an ink-jet recording head according to claim 1, wherein said basic waveform has a first falling portion falling down from a predetermined level to a first level, a rising portion rising from said first level to a second level, a retaining portion retaining said second level, and a second falling portion falling down from said second level to a third level.

11. An apparatus for driving an ink-jet recording head according to claim 1, wherein the drive wave form generated by said drive wave form generation circuit has a second portion which changes from a level of an end point in an n-th basic wave form to a level of a beginning point in a first basic wave form.

12. An apparatus for driving an ink-jet recording head according to claim 11, wherein said wave form extraction circuit extracts j basic wave forms (j is an integer equal to or greater than 1, and $j \leqq n$) continuing from the first basic wave form, from said first portion, in accordance with a print data from an outer portion, and extracts a portion corresponding to said extracted j basic wave forms from an end of said second portion.

13. A method of driving an ink-jet recording head comprising:

generating a drive waveform in which n basic waveforms are connected in series, each of said n basic waveforms having a single period, where n is an integer equal to or greater than 2;

extracting m (m is an integer, and $0 \leqq m \leqq n$) of said n basic waveforms as a print drive waveform based on an externally supplied print data; and applying said print drive waveform to a piezoelectric device to discharge an ink from a nozzle based on a distortion of said piezoelectric device, wherein said drive waveform generation circuit comprises a current amplifier for outputting an amplified signal as said drive waveform, and wherein the drive waveform generated by said generating has a first portion, in which a level of an end point in an i-th basic waveform (i is an integer equal to or greater than 1, and $i<n$) is equal to and connected to a level of a beginning point in an (i+1) -th basic waveform.

14. A method of driving an ink-jet recording head according to claim 13, wherein said basic waveform is formed such that an amplitude of a residual vibration of an ink meniscus at a tip portion of said nozzle is equal to or less than 30% of a maximum amplitude of said ink meniscus vibration of said nozzle, when said basic waveform is supplied to said piezoelectric device.

15. A method of driving an ink-jet recording head according to claim 13, wherein said basic waveform has a first rising portion rising from a predetermined level to a first level, a first retaining portion retaining said first level, a falling portion falling down from said first level to a second level, a second retaining portion retaining said second level, and a second rising portion rising from said second level to a third level.

16. A method of driving an ink-jet recording head according to claim 15, wherein an inclination of said first rising portion of said basic waveform is equal to an inclination of said second rising portion.

17. A method of driving an ink-jet recording head according to claim 15, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

18. A method of driving an ink-jet recording head according to claim 13, wherein said basic waveform has a first rising portion rising from a predetermined level to a first level, a falling portion falling down from said first level to a second level, a retaining portion retaining said second level, and a second rising portion rising from said second level to a third level.

19. A method of driving an ink-jet recording head according to claim 13, wherein said basic waveform has a first falling portion falling down from a predetermined level to a first level, a first retaining portion retaining said first level, a rising portion rising from said first level to a second level, a second retaining portion retaining said second level, and a second falling portion falling down from said second level to a third level.

20. A method of driving an ink-jet recording head according to claim 19, wherein an inclination of said first falling portion of said basic waveform is equal to an inclination of said second falling portion.

21. A method of driving an ink-jet recording head according to claim 19, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

22. A method of driving an ink-jet recording head according to claim 13, wherein said basic waveform has a first falling portion falling down from a predetermined level to a first level, a rising portion rising from said first level to a second level, a retaining portion retaining said second level, and a second falling portion falling down from said second level to a third level.

23. A method of driving an ink-jet recording head according to claim 13, wherein the drive wave form generated by said generating further includes a second portion which changes from a level of an end point in an n-th basic wave form to a level of a beginning point in a first basic wave form.

24. A method of driving an inkjet recording head according to claim 23, wherein said extracting extracts j basic wave forms (j is an integer equal to or greater than 1, and $j \leqq n$) continuing from the first basic wave form, from said first portion, in accordance with a print data from an outer portion, and extracts a portion corresponding to said extracted j basic wave forms from an end of said second portion.

25. An apparatus for driving an ink-jet recording head comprising:

a piezoelectric device;

a drive waveform generation circuit which generates a drive waveform in which n basic waveforms are connected in series, each of said n basic waveforms having a single period, where n is an integer equal to or greater than 2; and a waveform extraction circuit which extracts m (m is an integer, and $1 \leqq m \leqq n$) of said n basic waveforms as a print drive waveform based on an externally supplied print data, and applies said print drive waveform to said piezoelectric device, wherein an ink is discharged from a nozzle based on a distortion of said piezoelectric device, and wherein said basic waveform is formed such that an amplitude of a residual vibration of an ink meniscus at a tip portion of said nozzle is equal to or less than 30% of a maximum amplitude of said ink meniscus vibration of said nozzle, when said basic waveform is supplied to said piezoelectric device.

26. An apparatus for driving an ink-jet recording head according to claim 25, wherein said basic waveform has a first rising portion rising from a predetermined level to a first level, a first retaining portion retaining said first level, a falling portion falling down from said first level to a second level, a second retaining portion retaining said second level, and a second rising portion rising from said second level to a third level.

27. An apparatus for driving an ink-jet recording head according to claim 26, wherein an inclination of said first rising portion of said basic waveform is equal to an inclination of said second rising portion.

28. An apparatus for driving an ink-jet recording head according to claim 26, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

29. An apparatus for driving an ink-jet recording head according to claim 25, wherein said basic waveform has a first rising portion rising from a predetermined level to a first level, a falling portion falling down from said first level to a second level, a retaining portion retaining said second level, and a second rising portion rising from said second level to a third level.

30. An apparatus for driving an ink-jet recording head according to claim 29, wherein an inclination of said first rising portion of said basic waveform is equal to an inclination of said second rising portion.

31. An apparatus for driving an ink-jet recording head according to claim 29, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

32. An apparatus for driving an ink-jet recording head according to claim 25, wherein said basic waveform has a first falling portion falling down from a predetermined level to a first level, a first retaining portion retaining said first level, a rising portion from said first level to a second level, a second retaining portion retaining said second level, and a second falling portion falling down from said second level to a third level.

33. An apparatus for driving an ink-jet recording head according to claim 32, wherein an inclination of said first falling portion of said basic waveform is equal to an inclination of said second falling portion.

34. An apparatus for driving an ink-jet recording head according to claim 32, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

35. An apparatus for driving an ink-jet recording head according to claim 25, wherein said basic waveform has a first falling portion falling down from a predetermined level to a first level, a rising portion rising from said first level to a second level, a retaining portion retaining said second level, and a second falling portion falling down from said second level to a third level.

36. An apparatus for driving an ink-jet recording head according to claim 35, wherein an inclination of said first falling portion of said basic waveform is equal to an inclination of said second falling portion.

37. An apparatus for driving an ink-jet recording head according to claim 33, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

38. An apparatus for driving an ink-jet recording head according to claim 25, wherein a level of said print drive waveform finally falls down to a first basic level after said print drive waveform is applied to said piezoelectric device, said print drive waveform starting from said first basic level.

39. An apparatus for driving an ink-jet recording head according to claim 38, wherein a falling time of said print drive waveform is equal to a time period of said print drive waveform.

40. A method of driving an ink-jet recording head comprising:

generating a drive waveform in which n basic waveforms are connected in series, each of said n basic waveforms having a single period, where n is an integer equal to or greater than 2;

extracting m (m is an integer, and $1 \leqq m \leqq n$) of said n basic waveforms as a print drive waveform based on an externally supplied print data; and applying said print drive waveform to a piezoelectric device to discharge an ink from a nozzle based on a distortion of said piezoelectric device, wherein said basic waveform is formed such that amplitude of a residual vibration of an ink meniscus at a tip portion of said nozzle is equal to or less than 30% of a maximum amplitude of said ink meniscus vibration of said nozzle, when said basic waveform is supplied to said piezoelectric device.

41. A method of driving an ink-jet recording head according to claim 40, wherein said basic waveform has a first rising portion rising from a predetermined level to a first level, a first retaining portion retaining said first level, a falling portion falling down from said first level to a second level, a second retaining portion retaining said second level, and a second rising portion rising from said second level to a third level.

42. A method of driving an ink-jet recording head according to claim 4l, wherein an inclination of said first rising portion of said basic waveform is equal to an inclination of said second rising portion.

43. A method of driving an ink-jet recording head according to claim 41, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

44. A method of driving an ink-jet recording head according to claim 40, wherein said basic waveform has a first rising portion rising from a predetermined level to a first level, a falling portion failing down from said first level to a second level, a retaining portion retaining said second level, and a second rising portion rising from said second level to a third level.

45. A method of driving an ink-jet recording head according to claim 44, wherein an inclination of said first rising portion of said basic waveform is equal to an inclination of said second rising portion.

46. A method of driving an ink-jet recording head according to claim 44, wherein a time period of said first rising portion of said basic waveform is equal to or less than 0.4 times a period peculiar to an ink flow path, and a time period of said falling portion of said basic waveform is equal to or less than 0.4 times the period peculiar to the ink flow path.

47. A method of driving an ink-jet recording head according to claim 40, wherein said basic waveform has a first falling portion falling down from a predetermined level to a first level, a first retaining portion retaining said first level, a rising portion rising from said first level to a second level, a second retaining portion retaining said second level, and a second falling portion falling down from said second level to a third level.

48. A method of driving an ink-jet recording head according to claim 47, wherein an inclination of said first falling portion of said basic waveform is equal to an inclination of said second falling portion.

49. A method of driving an ink-jet recording head according to claim 47, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

50. A method of driving an ink-jet recording head according to claim 40, wherein said basic waveform has a first falling portion falling down from a predetermined level to a first level, a rising portion rising from said first level to a second level, a retaining portion retaining said second level, and a second falling portion falling down from said second level to a third level.

51. A method of driving an ink-jet recording head according to claim 50, wherein an inclination of said first falling portion of said basic waveform is equal to an inclination of said second falling portion.

52. A method of driving an ink-jet recording head according to claim 50, wherein a time period of said first falling portion of said basic waveform is equal to or less than 0.4 times a period peculiar to an ink flow path, and a time period of said rising portion of said basic waveform is equal to or less than 0.4 times the period peculiar to the ink flow path.

53. A method of driving an ink-jet recording head according to claim 40, wherein a level of said print drive waveform finally falls down to a first basic level after said print drive waveform is applied to said piezoelectric device, said print drive waveform starting from said first basic level.

54. A method of driving an ink-jet recording head according to claim 53, wherein a falling time of said print drive waveform is equal to a time period of said print drive waveform.

* * * * *